US006842733B1

(12) United States Patent
Gao et al.

(10) Patent No.: US 6,842,733 B1
(45) **Date of Patent: *Jan. 11, 2005**

(54) SIGNAL PROCESSING SYSTEM FOR FILTERING SPECTRAL CONTENT OF A SIGNAL FOR SPEECH CODING

(75) Inventors: Yang Gao, Mission Viejo, CA (US); Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 720 days.

This patent is subject to a terminal disclaimer.

(21) Appl. No.: 09/781,735

(22) Filed: Feb. 12, 2001

Related U.S. Application Data

(60) Provisional application No. 60/233,044, filed on Sep. 15, 2000.

(51) Int. Cl.[7] ..... G10L 19/14

(52) U.S. Cl. ..... 704/224; 704/203; 704/205

(58) Field of Search ..... 704/205, 278, 704/207, 203, 200.1

(56) References Cited

U.S. PATENT DOCUMENTS

| | | | | |
|---|---|---|---|---|
| 4,969,192 A | | 11/1990 | Chen et al. | |
| 5,233,660 A | | 8/1993 | Chen | |
| 5,293,449 A | | 3/1994 | Tzeng | |
| 5,307,441 A | | 4/1994 | Tzeng | |
| 5,323,486 A | | 6/1994 | Taniguchi et al. | |
| 5,396,576 A | | 3/1995 | Miki et al. | |
| 5,451,951 A | | 9/1995 | Elliott | |
| 5,615,298 A | | 3/1997 | Chen | |
| 5,657,420 A | | 8/1997 | Jacobs et al. | |
| 5,664,055 A | | 9/1997 | Kroon | |
| 5,682,404 A | | 10/1997 | Miller | |
| 5,692,098 A | * | 11/1997 | Kurdziel | 704/202 |
| 5,734,789 A | | 3/1998 | Swaminathan et al. | |
| 5,778,335 A | | 7/1998 | Ubale et al. | |
| 5,778,338 A | | 7/1998 | Jacobs et al. | |
| 5,826,226 A | | 10/1998 | Ozawa | |
| 5,864,798 A | * | 1/1999 | Miseki et al. | 704/225 |
| 5,884,010 A | | 3/1999 | Chen et al. | |
| 5,899,968 A | | 5/1999 | Navarro et al. | |
| 5,995,539 A | | 11/1999 | Miller | |
| 6,073,092 A | | 6/2000 | Kwon | |
| 6,167,371 A | * | 12/2000 | Miet et al. | 704/205 |
| 2002/0143527 A1 | * | 10/2002 | Gao et al. | 704/223 |

OTHER PUBLICATIONS

W. Bastiaan Kleijn et al., "The RCELP Speech–Coding Algorithm"; vol. 5, No. 5; Sep.–Oct. 1994; pp. 38/573–47/581.

C. Laflamme et al.; "On Reducing Computational Complexity of Codebook Search in CELP Coder Through the Use of Algebraic Codes"; 1990 IEEE; pp. 177–180.

Erdal Paksoy et al., "A Variable–Rate Multimodal Speech Coder with Gain–Matched Analysis–By–Synthesis"; IEEE, 1997, pp. 751–754.

"Draft Recommendation G.729, Coding of Speech at 8 kbit/s Using Conjugate–Structure Algebraic–Code–Excited Linear–Predictive (CS–ACELP) Coding"; International Telecommunication Union Telecommunications Standardization Sector, Jun. 1995, pp. i–iv and 1–42.

(List continued on next page.)

*Primary Examiner*—Susan McFadden
*Assistant Examiner*—Jakieda Jackson
(74) *Attorney, Agent, or Firm*—Farjami & Farjami LLP

(57) ABSTRACT

A signal processing system is well suited for conditioning a speech signal prior to coding the speech signal to achieve enhanced perceptual quality of reproduced speech. The signal processing system may be incorporated into mobile or portable wireless communications devices, wireless infrastructure equipment, or both. The signal processing system includes a filtering arrangement for filtering an input speech signal to make a spectral response of the speech signal more uniform to compensate for spectral variations that might otherwise be imparted into the speech signal by a communications network associated with the signal processing system.

34 Claims, 8 Drawing Sheets

OTHER PUBLICATIONS

"Digital Cellular Telecommunications System; Comfort Noise Aspects for Enhanced Full Rate (EFR) Speech Traffic Channels (GSM 06.62)" European Telecommunications Standards Institute Publication Reference DE/SMG–020662; May 1996; pp. 1–16.

W. B. Kleijn et al., Speech Coding and Synthesis, 1995, pp. 81–113.

Amitava Das et al., "Multimode and Variable–Rate Coding of Speech"; Speech Coding and Synthesis Chapter 7,–1995, pp. 257–288.

Tomohiko Taniguchi et al., "Structured Stochastic Codebook and Codebook Adaptation for CELP", Speech and Audio Coding for Wireless and Network Applications, Chapter 27, 1993, pp. 217–224.

Ira A. Gerson et al., "Vector Sum Excited Linear Prediction (VSELP)"; Motorola Inc; Advances in Speech Coding; Chapter 7, 1991, pp. 69–79.

J.P. Campbell, Jr. et al., "The DOD 4.8 KBPS Standard (Proposed Federal Standard 1016)", Advances in Speech Coding, Chapter 12, 1991, pp. 121–133.

R.A. Salami, "Binary Pulse Excitation: A Novel Approach to Low Complexity CELP Coding"; Advances in Speech Coding, Chapter 14, 1991, pp. 145–157.

Chih–Chung Kuo et al., Speech Classification Emedded in Adaptive Codebook Search for Low Bit–Rate CELP Coding, IEEET Transactions on Speech and Audio Processing, vol. 3, No. 1, Jan. 1995.

* cited by examiner

SIGNAL PROCESSING SYSTEM FOR FILTERING SPECTRAL CONTENT OF A SIGNAL FOR SPEECH CODING

CROSS REFERENCE TO RELATED APPLICATIONS

This application claims the benefit of provisional application Ser. No. 60/233,044, entitled SIGNAL PROCESSING SYSTEM FOR FILTERING SPECTRAL CONTENT OF A SIGNAL FOR SPEECH CODING, filed on Sep. 15, 2000 under 35 U.S.C. 119(e).

BACKGROUND OF THE INVENTION

1. Technical Field

This invention relates to a signal processing system for filtering the spectral content of a speech signal. In addition, the invention relates to a signal processing system or a coding system for coding the speech signal following the filtering to promote uniform reproduction of the speech signal.

2. Related Art

An analog portion of a communications network may detract from the desired audio characteristics of vocoded speech. In a public switched telephone network, a trunk between exchanges or a local loop from a local office to a fixed subscriber station may use analog representations of the speech signal. For example, a telephone station typically transmits an analog modulated signal with an approximately 3.4 KHz bandwidth to the local office over the local loop. The local office may include a channel bank that converts the analog signal to a digital pulse-code-modulated signal (e.g., DS0). An encoder in a base station may subsequently encode the digital signal, which remains subject to the frequency response originally imparted by the analog local loop and the telephone.

The analog portion of the communications network may skew the frequency response of a voice message transmitted through the network. A skewed frequency response may negatively impact the digital speech coding process because the digital speech coding process may be optimized for a different frequency response than the skewed frequency response. As a result, analog portion may degrade the intelligibility, consistency, realism, clarity or another performance aspect of the digital speech coding.

The change in the frequency response may be modeled as one or more modeling filters interposed in a path of the voice signal traversing an ideal analog communications network with an otherwise flat spectral response. A Modified Intermediate Reference System (MIRS) refers to a modeling filter or another model of the spectral response of a voice signal path in a communications network. If a voice signal that has a flat spectral response is inputted into an MIRS filter, the output signal has a sloped spectral response with amplitude that generally increases with a corresponding increase in frequency.

To compensate for the higher spectral output at higher frequencies of the voice signal consistent with the virtual MIRS filter, the analog communications system may include an actual low pass filter at each receiving end of a communications link to produce a flat spectral response, as opposed to a skewed spectral response. An issue arises on whether to design encoders for base stations and mobile stations that include a low pass filter to compensate for the spectral response of an analog portion of a communications network. If the analog portion affects the actual spectral response of the voice signal differently from an expected spectral response of the MIRS filter model, the resultant reproduced speech may sound odd or artificial. For example, the resultant speech may be distorted by the application of a lowpass filter that attenuates high frequency components of the voice signal that deviates from the MIRS filter model. Similarly, if no analog portion is present in the path of the voice signal, the coding performance suffers because of the presence of the superfluous low pass filter may destroy desired speech information in the high frequency region. Thus, a need exists for a system for filtering the spectral content of a signal for speech coding in a balanced manner based on the spectral characteristics of the input voice signal to be encoded.

SUMMARY

A signal processing system is well suited for conditioning a speech signal prior to coding the speech signal to achieve enhanced perceptual quality of reproduced speech. The signal processing system may be incorporated into mobile or portable wireless communications devices, wireless infrastructure equipment, or both. The signal processing system may include a filtering arrangement for filtering an input speech signal to make a spectral response of the speech signal more uniform to compensate for spectral variations that might otherwise be imparted into the speech signal by a communications network associated with the signal processing system.

The filtering arrangement accumulates samples of the speech signal over at least a minimum sampling duration. The filtering arrangement evaluates accumulated samples associated with the minimum sampling period to obtain a representative sample. The filtering arrangement determines whether a slope of the representative sample of the speech signal conforms to a defined characteristic slope stored in a reference database of spectral characteristics. The filtering arrangement selects a first filter, a second filter, or no filter for application to the speech signal prior to the coding based on the determination on the slope of the representative sample.

If a speech signal satisfies a certain spectral criteria (e.g., a positively sloped spectral response), the first filter may be applied to lessen a slope of the speech signal to approach a flatter spectral response in preparation for the coding. If the speech signal satisfies a different spectral criteria (e.g., a flat spectral response), the second filter may be applied to increase a slope of the spectral response of the speech signal to approach a more sloped spectral response than the flat spectral response in preparation for prospective speech coding. Accordingly, the resultant spectral response of the filtered speech signal may have an intermediate slope that falls between a flat spectral response and a positively sloped spectral response, such as a Modified Intermediate Reference System response.

In one configuration, which may supplement the foregoing filtering procedure, the signal processing system may comprise a coder or another device that adjusts one or more coding parameters based on a degree of slope of the spectral response of the speech signal. For example, an encoder may adjust one or more of the following: at least one weighting filter coefficient of a perceptual weighting filter of the encoder, at least one bandwidth expansion constant for a synthesis filter of the encoder, at least one bandwidth expansion constant for an analysis filter, at least one filter coefficient for a post filter coupled to a decoder, pitch gains per frame or sub-frame of the encoder, and any other coding parameter or decoding parameter to enhance the perceptual quality of the reproduced speech signal. In preferred embodiments discussed in the specification that follows, preferential values for the coding parameters are related to mathematical equations that define filtering operations.

Other systems, methods, features and advantages of the invention will be apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

Like reference numerals designate corresponding elements throughout the different figures.

DETAILED DESCRIPTION OF THE PREFERRED EMBODIMENT

The term coding refers to encoding of a speech signal, decoding of a speech signal or both. An encoder codes or encodes a speech signal, whereas a decoder codes or decodes a speech signal. The encoder may determine certain coding parameters that are used both in an encoder to encode a speech signal and a decoder to decode the encoded speech signal. The term coder refers to an encoder or a decoder.

Figure 1:
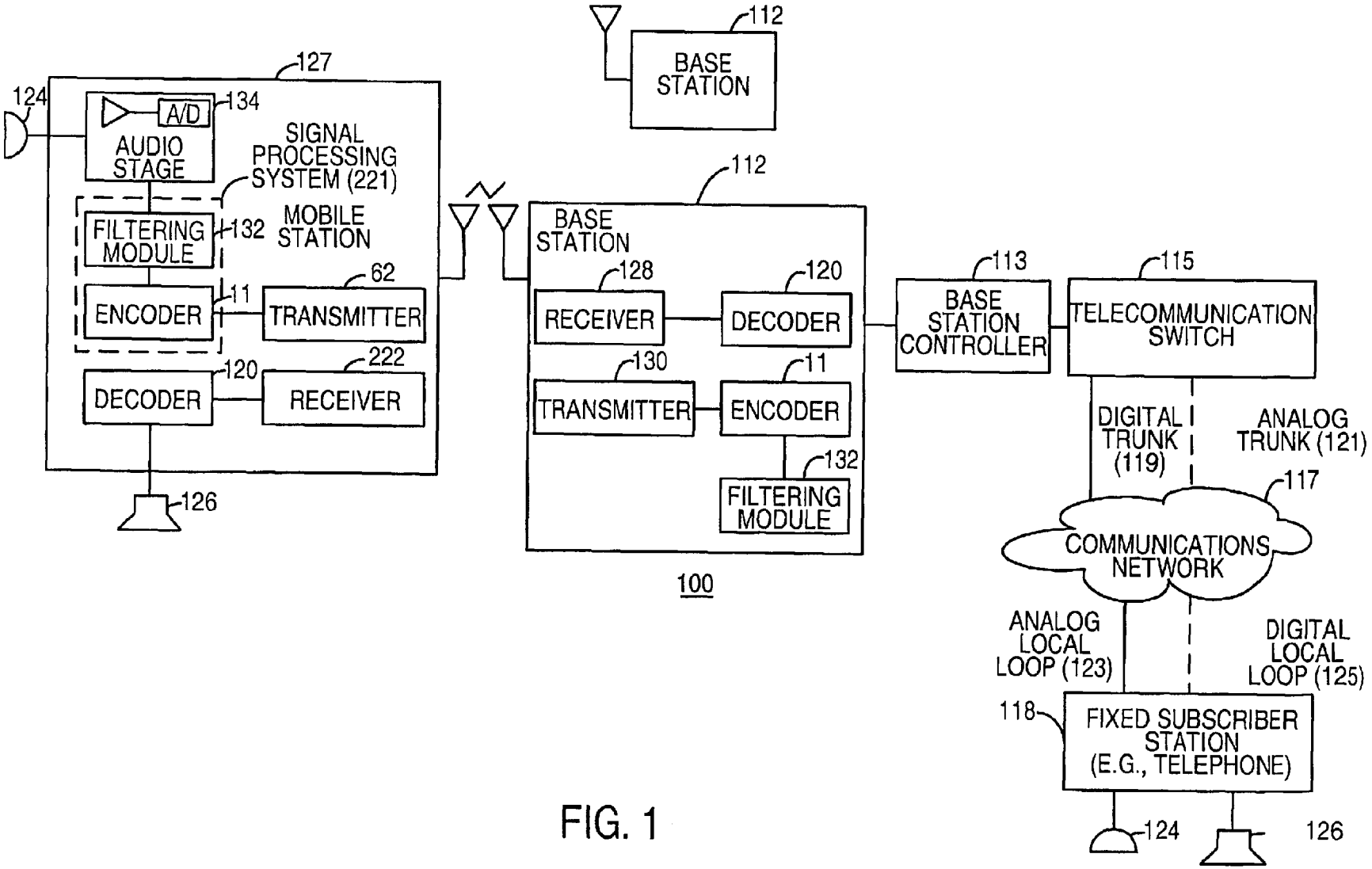
FIG. 1 is a block diagram of a communications system incorporating a signal processing system.

FIG. 1 shows a block diagram of a communications system 100 that incorporates a signal processing system 221. The communications system 100 includes a mobile station 127 that communicates to a base station 112 via electromagnetic energy (e.g., radio frequency signal) consistent with an air interface. In turn, the base station 112 may communicate with a fixed subscriber station 118 via a base station controller 113, a telecommunications switch 115, and a communications network 117. The base station controller 113 may control access of the mobile station 127 to the base station 112 and allocate a channel of the air interface to the mobile station 127. The telecommunications switch 115 may provide an interface for a wireless portion of the communications system 100 to the communications network 117.

For an uplink transmission from the mobile station 127 to the base station 112, the mobile station 127 has a microphone 124 that receives an audible speech message of acoustic vibrations from a speaker or source. The microphone 124 transduces the audible speech message into a speech signal. In one embodiment, the microphone 124 has a generally flat spectral response across a bandwidth of the audible speech message so long as the speaker has a proper distance and position with respect to the microphone 124. An audio stage 134 preferably amplifies and digitizes the speech signal. For example, the audio stage 134 may include an amplifier with its output coupled to an input of an analog-to-digital converter. The audio stage 134 inputs the speech signal into the signal processing system 221.

The signal processing system 221 includes a filtering module 132 and an encoder 11. A filtering module 132 prepares the speech signal for encoding of the encoder 11 by enhancing the uniformity of the spectral response associated with the speech signal. At the mobile station 127, the spectral response of the outgoing speech signal may be influenced by one or more of the following factors: (1) frequency response of the microphone 124, (2) position and distance of the microphone 124 with respect to a source (e.g., speaker's mouth) of the audible speech message, and (3) frequency response of an audio stage 134 that amplifies the output of the microphone 124.

A spectral response refers to the energy distribution (e.g., magnitude versus frequency) of the voice signal over at least part of bandwidth of the voice signal. A flat spectral response refers to an energy distribution that is generally evenly distributed over the bandwidth. A sloped spectral response refers to an energy distribution that follows a generally linear or curved contour versus frequency, where the energy distribution is not evenly distributed over the bandwidth.

A first spectral response refers to a voice signal with a sloped spectral response where the higher frequency components have greater amplitude than the lower frequency components of the voice signal. A second spectral response refers to a voice signal where the higher frequency components and the lower frequency components of the voice signal have generally equivalent amplitudes within a defined range of each other.

The spectral response of the outgoing speech signal, which is inputted into the signal processing system 221, may vary. In one example, the spectral response may be generally flat with respect to most frequencies over the bandwidth of the speech message. In another example, the spectral response may have a generally linear slope that indicates an amplitude that increases with frequency over the bandwidth of the speech message. For instance, an MIRS response has an amplitude that increases with a corresponding increase in frequency over the bandwidth of the speech message.

For an uplink transmission, the filtering module 132 of the mobile station 127 determines which reference spectral response most closely resembles the spectral response of the input speech signal, provided at an input of the signal processing system 221. The filtering module 132 in the mobile station 127 may apply equalization, attenuation or other filtering to improve the uniformity of the spectral response inputted into the encoder 11, to compensate for spectral disparities that might otherwise be present in the speech signal. For example, the filtering module 132 may compensate for spectral disparities that might otherwise be introduced into the encoded speech signal because of the relative position of the speaker with respect to the microphone 124 or the frequency response of the audio stage 134.

The encoder 11 reduces redundant information in the speech signal or otherwise reduces a greater volume of data of an input speech signal to a lesser volume of data of an encoded speech signal. The encoder 11 may comprise a coder, a vocoder, a codec, or another device for facilitating efficient transmission of information over the air interface between the mobile station 127 and the base station 112. In one embodiment, the encoder 11 comprises a code-excited linear prediction (CELP) coder or a variant of the CELP coder. In an alternate embodiment, the encoder 11 may comprise a parametric coder, such as a harmonic encoder or a waveform-interpolation encoder. The encoder 11 is coupled to a transmitter 62 for transmitting the coded signal over the air interface to the base station 112.

The base station 112 may include a receiver 128 coupled to a decoder 120. At the base station 112, the receiver 128 receives a transmitted signal transmitted by the transmitter 62. The receiver 128 provides the received speech signal to the decoder 120 for decoding and reproduction on the speaker 126 (i.e., transducer). A decoder 120 reconstructs a replica or facsimile of the speech message inputted into the microphone 124 of the mobile station 127. The decoder 120 reconstructs the speech message by performing inverse operations on the encoded signal with respect to the encoder 11 of the mobile station 127. The decoder 120 or an affiliated communications device sends the decoded signal over the network to the subscriber station (e.g., fixed subscriber station 118).

For a downlink transmission from the base station 112 to the mobile station 127, a source at the fixed subscriber station 118 (e.g., a telephone set) may speak into a microphone 124 of the fixed subscriber station 118 to produce a speech message. The fixed subscriber station 118 transmits the speech message over the communications network 117 via one of various alternative communications paths to the base station 112.

Each of the alternate communications paths may provide a different spectral response of the speech signal that is applied to filter module 132 of the base station 112. Three examples of communications paths are shown in FIG. 1 for illustrative purposes, although an actual communications network (e.g., a switched circuit network or a data packet network with a web of telecommunications switches) may contain virtually any number of alternative communication paths. In accordance with a first communications path, a local loop between the fixed subscriber station 118 and a local office of the communications network 117 represents an analog local loop 123, whereas a trunk between the communications network 117 and the telecommunications switch 115 is a digital trunk 119. In accordance with second communications path, the speech signal traverses a digital signal path through synchronous digital hierarchy equipment, which includes a digital local loop 125 and a digital trunk 119 between the communications network 117 and the telecommunications switch 115. In accordance with a third communications path, the speech signal traverses over an analog local loop 123 and an analog trunk 121 (e.g., frequency-division multiplexed trunk) between the communications network 117 and the telecommunications switch 115, for example.

The spectral response of any of the three illustrative communications paths may be flat or may be sloped. The slope may or may not be consistent with an MIRS model of a telecommunications system, although the slope may vary from network to network. For a downlink transmission, the filtering module 132 of the base station 112 determines which type of reference spectral response most closely resembles the spectral response of the input speech signal, received via a base station controller 113. The filtering module 132 of the base station 112 applies equalization, attenuation, or other filtering to improve the uniformity of the spectral response inputted into the encoder 11 of the base station 112 regardless of the communications path traversed over the communications network 117 between the fixed subscriber station 118 and the base station 112.

The filtering module 132 selects a first filter 166 (FIG. 3) associated with the first spectral response or a second filter 168 (FIG. 3) associated with a second spectral response based on the detection result of the detector. If the detector determines that the voice signal conforms to the first spectral response, the voice signal having the first spectral response is inputted into a first filter 166. However, if the detector determines that the voice signal conforms to the second spectral response, the voice signal having the second spectral response is inputted to a second filter 168. The filtering module 132 selects the first filter 166 or the second filter 168 to provide a resultant voice signal with a uniform spectral content for input to an encoder 11. Whichever filter is selected applies a filtering characteristic that provides an intermediate slope between the higher slope of the first spectral response and the flatness of the second spectral response.

In one embodiment, after filtering the resultant voice signal has an intermediately sloped spectral response that falls between a generally flat spectral response and a positively sloped spectral response associated with a MIRS-type filter. Accordingly, the speech encoder 11 consistently reproduces speech in a reliable manner that is relatively independent of the presence of analog portions of a communications network. Further, the above technique facilitates the production of natural-sounding or intelligible speech by the encoder 11 in a consistent manner from call-to-call and from one location to another within a wireless communications service area.

The encoder 11 at the base station 112 encodes the speech signal from the filtering module 132. For a downlink transmission, the transmitter 130 transmits an encoded signal over the air interface to a receiver 222 of the mobile station 127. The mobile station 127 includes a decoder 120 coupled to the receiver 222 for decoding the encoded signal. The decoded speech signal may be provided in the form of an audible, reproduced speech signal at a speaker 126 or another transducer of the mobile station 127.

Figure 2B:
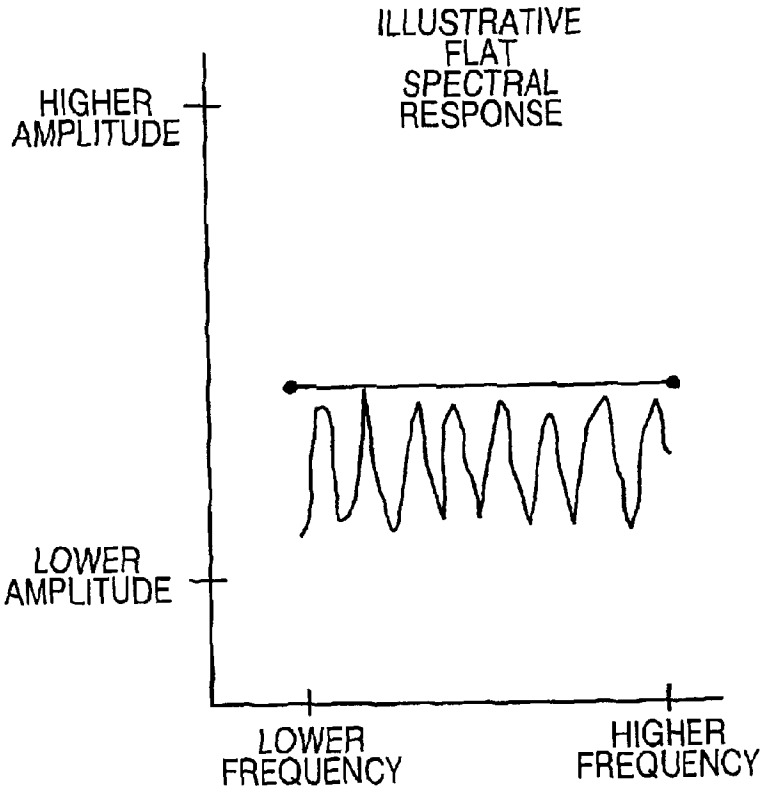
FIG. 2B is a graph of an illustrative flat spectral response of a speech signal with a generally constant amplitude over different frequencies.
Figure 2A:
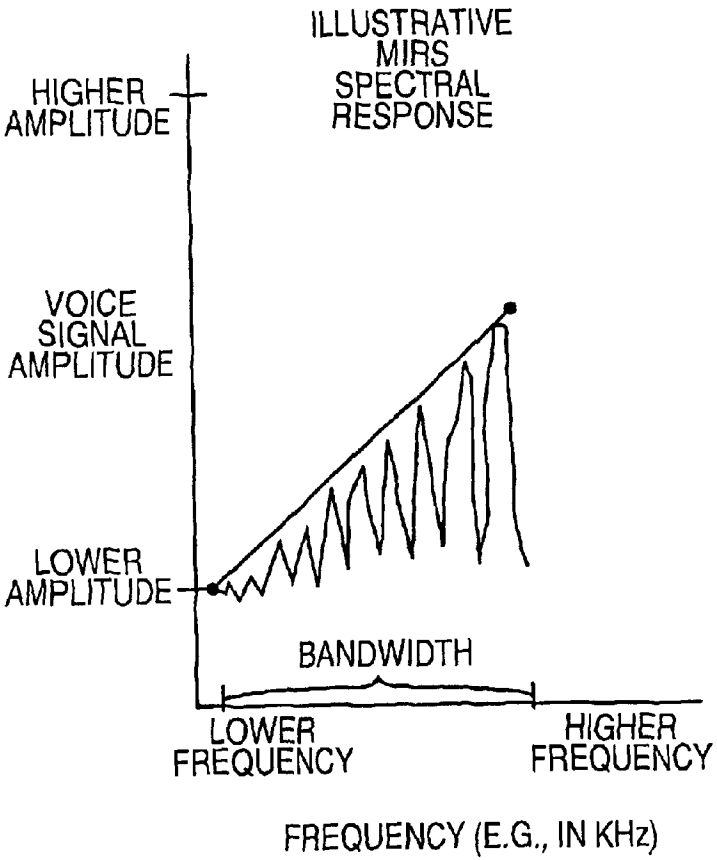
FIG. 2A is a graph of an illustrative sloped spectral response of a speech signal with an amplitude that that increases with a corresponding increase in frequency.

FIG. 2A shows an illustrative graph of a positively sloped spectral response (e.g., MIRS spectral response) associated with a network with at least one analog portion. For example, FIG. 2A may represent the first spectral response, as previously defined herein. The vertical axis represents an amplitude of a voice signal. The horizontal axis represents frequency of the voice signal. The spectral response is sloped or tilted to represent that the amplitude of the voice signal increases with a corresponding increase in the frequency component of the voice signal. The voice signal may have a bandwidth that ranges from a lower frequency to a higher frequency. At the lower frequency, the spectral response has a lower amplitude, while at the higher frequency the spectral response has a higher amplitude. In the context of an MIRS response, the slope shown in FIG. 2A may represent a 6 dB per octave (i.e., a standard measure of change in frequency) slope. Although the slope shown in FIG. 2A is generally linear, in an alternate example of spectral response, the slope may be depicted as a curved slope. Although the slope of FIG. 2A intercepts the peak amplitudes of the speech signal, in an alternate example, the slope may intercept the root mean squared average of the signal amplitude or another baseline value.

FIG. 2B is a graph of a flat spectral response. A flat spectral response may be associated with a network with predominately digital infrastructure. For example, FIG. 2B may represent the second spectral response, as previously defined herein. The vertical axis represents an amplitude of a voice signal. The horizontal axis represents a frequency of the voice signal. The flat spectral response generally has a slope approaching zero, as expressed by the generally horizontal line extending intermediately between the higher amplitude and the lower amplitude. Accordingly, the flat spectral response has approximately the same intermediate amplitude at the lower frequency and the higher frequency. Although the horizontal line intercepts the peak amplitude of the voice signal, in an alternative example, the horizontal line may intercept the root mean squared average of the signal amplitude or another baseline value of the speech signal.

Figure 3:
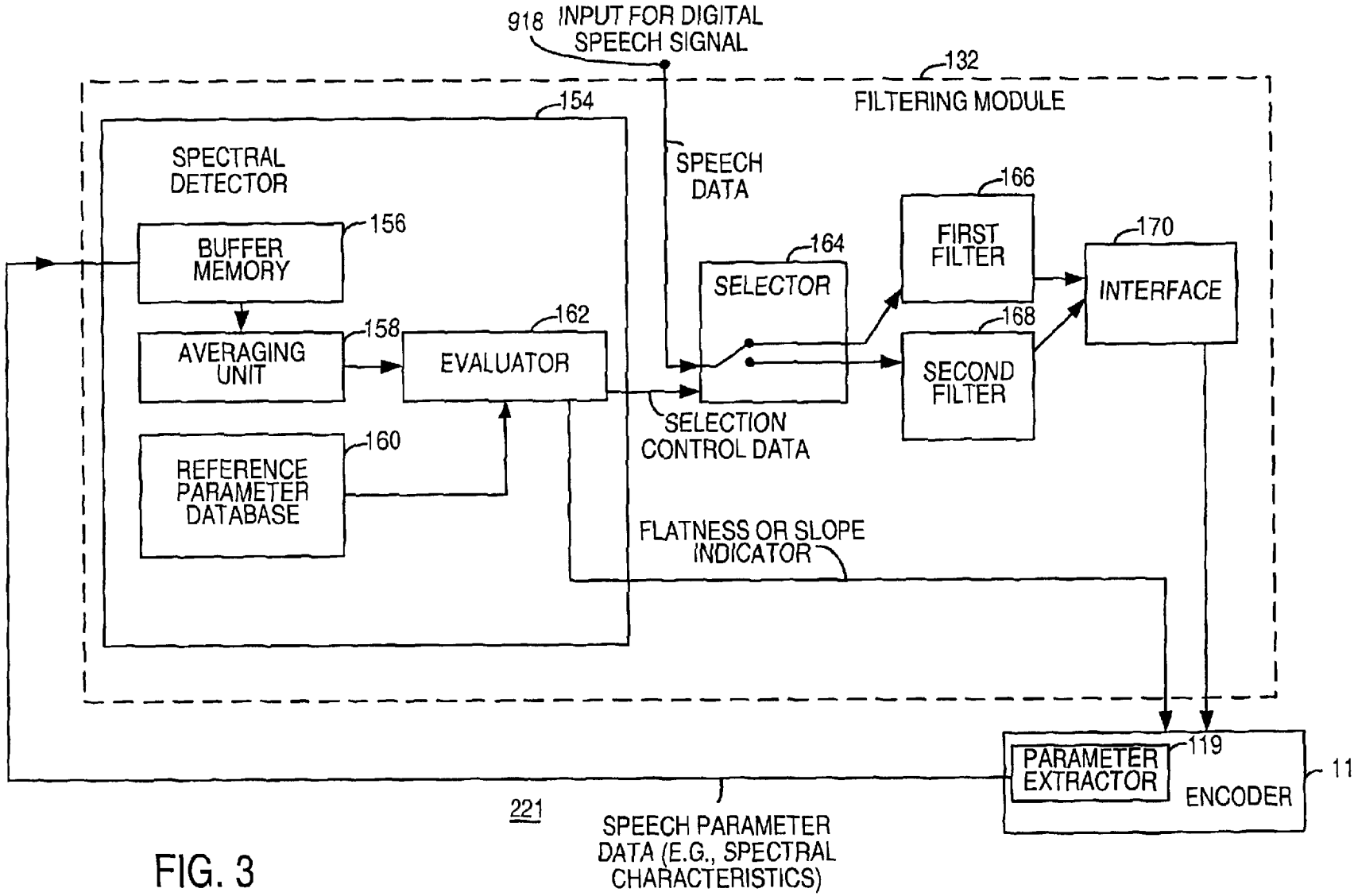
FIG. 3 is a block diagram that shows the signal processing system of FIG. 1 in greater detail.

FIG. 3 is a block diagram of a signal processing system 221 of FIG. 1 in greater detail. The signal processing system 221 of FIG. 3 includes a spectral detector 154 coupled to a selector 164. In turn, the selector 164 is selectably associated with (e.g., switched to interconnect to) a first filter 166 or a second filter 168. The first filter 166 and the second filter 168 may be coupled to an interface 170 for interfacing the first filter 166 and the second filter 168 to the encoder 11.

The encoder 11 includes a parameter extractor 119 for extracting speech parameters from the speech signal inputted into the encoder 11 from the filtering module 132. The speech parameters relate to the spectral characteristics of the speech signal that is inputted into the encoder 1. The inputted speech signal may be filtered by the first filter 166 or the second filter 168 prior to application to the encoder 11, although during an initial evaluation period the filtering module 132 typically invokes the first filter 166 as a preliminary or default measure.

The spectral detector 154 includes buffer memory 156 for receiving the speech parameters as input. The buffer memory 156 stores speech parameters representative of a minimum number of frames of the speech signal or a minimum duration of the speech signal sufficient to accurately evaluate the spectral response or content of the input speech signal.

The buffer memory 156 is coupled to an averaging unit 158 that averages the signal parameters over the minimum duration of the speech signal sufficient to accurately evaluate the spectral response. An evaluator 162 receives the averaged signal parameters from the averaging unit 158 and accesses reference signal parameters from the reference parameter database 160 for comparison. The evaluator 162 compares the averaged signal parameters to the accessed reference signal parameters to produce selection control data for input to the selector 164. The reference signal parameters represent spectral characteristic data, such a first spectral response, a second spectral response, or any other defined reference spectral response. The reference signal parameters may be stored in a reference database or another storage device, such as non-volatile electronic memory. In accordance with the first spectral response, the higher frequency components have a greater amplitude than the lower frequency components of the voice signal. For example, the first spectral response may conform to a MIRS characteristic, an IRS characteristic, or another standard model that models the spectral response of a channel of a communications network. In accordance with the second spectral response, the higher frequency components and the lower frequency components have generally equivalent amplitudes within a defined range.

The evaluator 162 determines which reference speech parameters most closely match the received speech parameters to identify the closest reference spectral response to the actual spectral response of the speech signal presented to the encoder 11. The evaluator 162 provides control selection data to the selector 164 for controlling the state of the selector 164. The control selection data controls the selector 164 to select the first filter 166 if the received speech parameters are closest to the first spectral response, as opposed to the second spectral response. In contrast, the control selection data controls the selector 164 to select the second filter 168 if the received spectral parameters are closest to the second spectral response, as opposed to the first spectral response.

In one embodiment, the evaluator 162 provides a flatness or slope indicator on the speech signal to the encoder 11. The flatness or slope indicator may represent the absolute slope of the spectral response of the received signal, or the degree that the flatness or slope varies from a reference spectral response (e.g., the first spectral response). Accordingly, the evaluator 162 may trigger an adjustment or selection of at least one coding parameter value based on the degree of flatness or slope of the input speech signal during a coding process. The coding parameter value may be selected to coincide with the active or selected one of the first filter 166 and the second filter 168 at any given time. In one example, the evaluator triggers an adjustment of at least one coding parameter value to a revised coding parameter value.

The digital signal input of the speech signal is applied to an input port 918 of the selector 164 of the filtering module 132 prior to application to the encoder 11. The digital signal input may be supplied by an audio stage 134 of a mobile station 127 or an output of a base station controller 113 as shown in FIG. 1. The selector 164 may comprise a switching matrix that includes a first state and a second state. Under the first state, the inputted speech signal (i.e., the digital signal input) is routed to the first filter 166. Under the second state, the inputted speech signal is routed to the second filter 168.

The interface 170 refers to a communications device for managing communication between the filtering module 132 and the encoder 11. The first filter 166 and the second filter 168 are preferably coupled to the interface 170. The communications device may include a buffer memory for storing output of the first filter 166 or the second filter 168 consistent with the throughput and data protocol of the encoder 11.

Although the embodiment of FIG. 3 includes one encoder 11 and an interface 170, in an alternate embodiment, the encoder 11 and the interface 170 may be replaced by a first encoder coupled to the first filter 166 and a second encoder coupled to the second filter 168. Accordingly, the first encoder and the second encoder may be optimized for the expected output of the first filter 166 and the second filter 168, respectively.

Although the embodiment of FIG. 3 includes an encoder 11 with an input for flatness indicator or a slope indicator of the speech signal, in another alternate embodiment, the input for the flatness indicator or the slope indicator may be omitted. This omission may be present where the encoder 11 does not adjust any encoding parameters or select encoding parameters from a candidate group of encoding parameters during the encoding procedure based on the detected flatness indicator or the detected slope indicator.

In yet another alternate embodiment, the filtering module 132 includes a third filter or a filter bypass signal path coupled to the selector 164 and the interface 170. Accordingly, the selector 164 would select from an appropriate filter among the first filter 166, the second filter 168, and the third filter or the filter bypass signal path on a frame-by-frame basis or otherwise. The third filter may be configured to compensate for the spectral characteristics of a microphone 124 on a mobile station or any other communications device that impacts the spectral response of the speech signal.

Figure 4A:
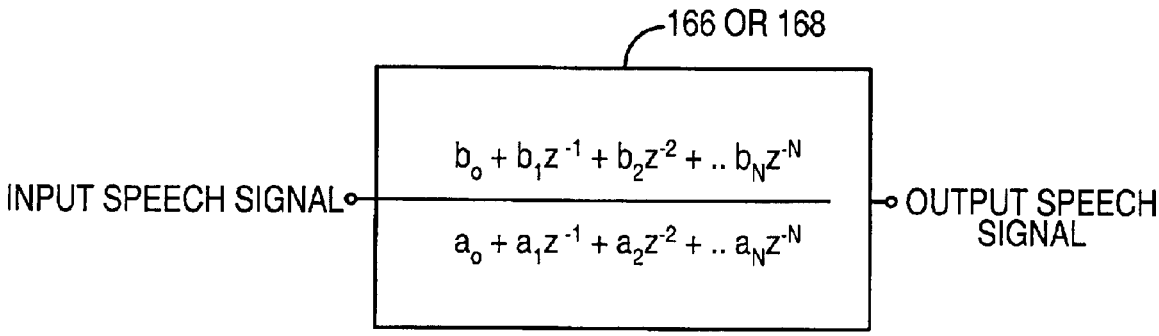
FIG. 4A is a mathematical representation of one embodiment of the filter response of a first filter or a second filter of FIG. 3 in greater detail.

FIG. 4A is an illustrative embodiment of the first filter 166 or the second filter 168. The first filter 166 or the second filter 168 may be expressed mathematically as the following general equation:

$$H(z) = \frac{b_0 + b_1 z^{-1} + b_2 z^{-2} + \ldots b_N z^{-N}}{a_0 + a_1 z^{-1} + a_2 z^{-2} + \ldots a_N z^{-N}}$$

where H(z) is a transfer function that indicates an output of the filter (e.g., first filter 166 or the second filter 168) in the z domain, N is the order of the filter, $b_0$, $b_1$, $b_2$, and $b_N$ are filter coefficients which may vary over time, $a_0$, $a_1$, $a_2$, and $a_N$ are filter coefficients which may vary over time, z represents a positive integer with exponents that represent the passage of time. The filter configuration of FIG. 4A represents a hybrid pole/zero filter that may be used for the first filter 166, the second filter 168, or both.

Figure 4B:
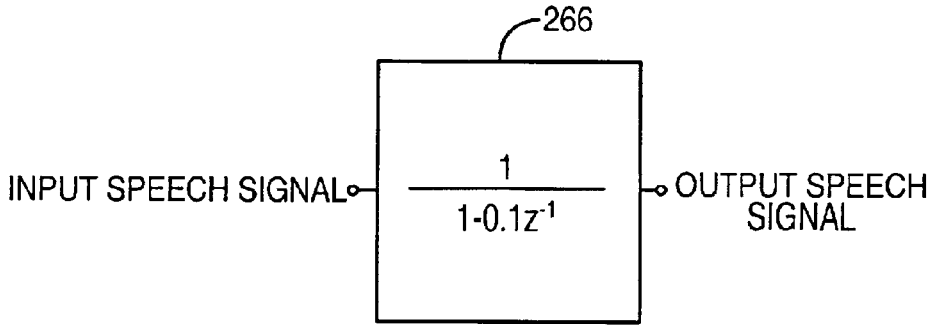
FIG. 4B is a mathematical representation of the filter response of another embodiment of a first filter of FIG. 3.

To simplify computation of the filter coefficients associated with FIG. 4A, the above equation may be replaced with the following equation:

$$H(z) = \frac{1}{1 - cz^{-1}}$$

where H(z) is a transfer function that indicates the spectral response of the filter's output, z represents any positive integer, and c is a delay coefficient. The first filter 266 and the second filter 268 of FIG. 4B and FIG. 4C conform to the above equation. The first filter 266 and the second filter 268 each comprise a one-pole filter as expressed by the above equation to facilitate reduced signal processing resources and power consumption in the realization of the first filter 266 and the second filter 268. In FIG. 4B, c is approximately equal to 0.1.

Figure 4C:
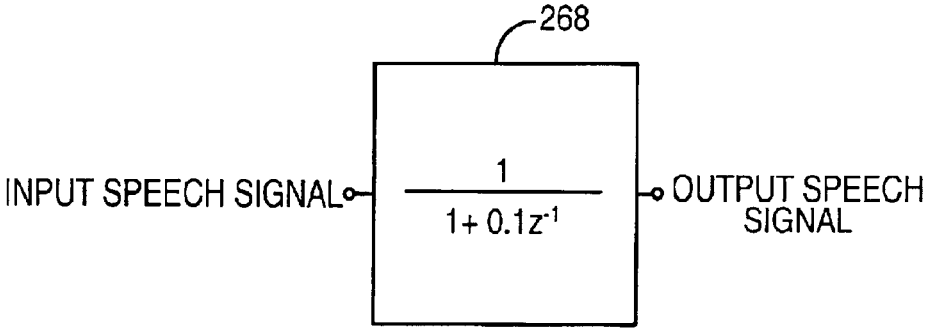
FIG. 4C is a mathematical representation of the filter response of another embodiment of a second filter of FIG. 3.

The second filter 268 of FIG. 4C is identical to the first filter 266 of FIG. 4B except the delay coefficient c of the second filter 268 differs from the delay coefficient of the first filter 266. The second filter 268 has a delay coefficient c equal to approximately −0.1.

Figure 5:
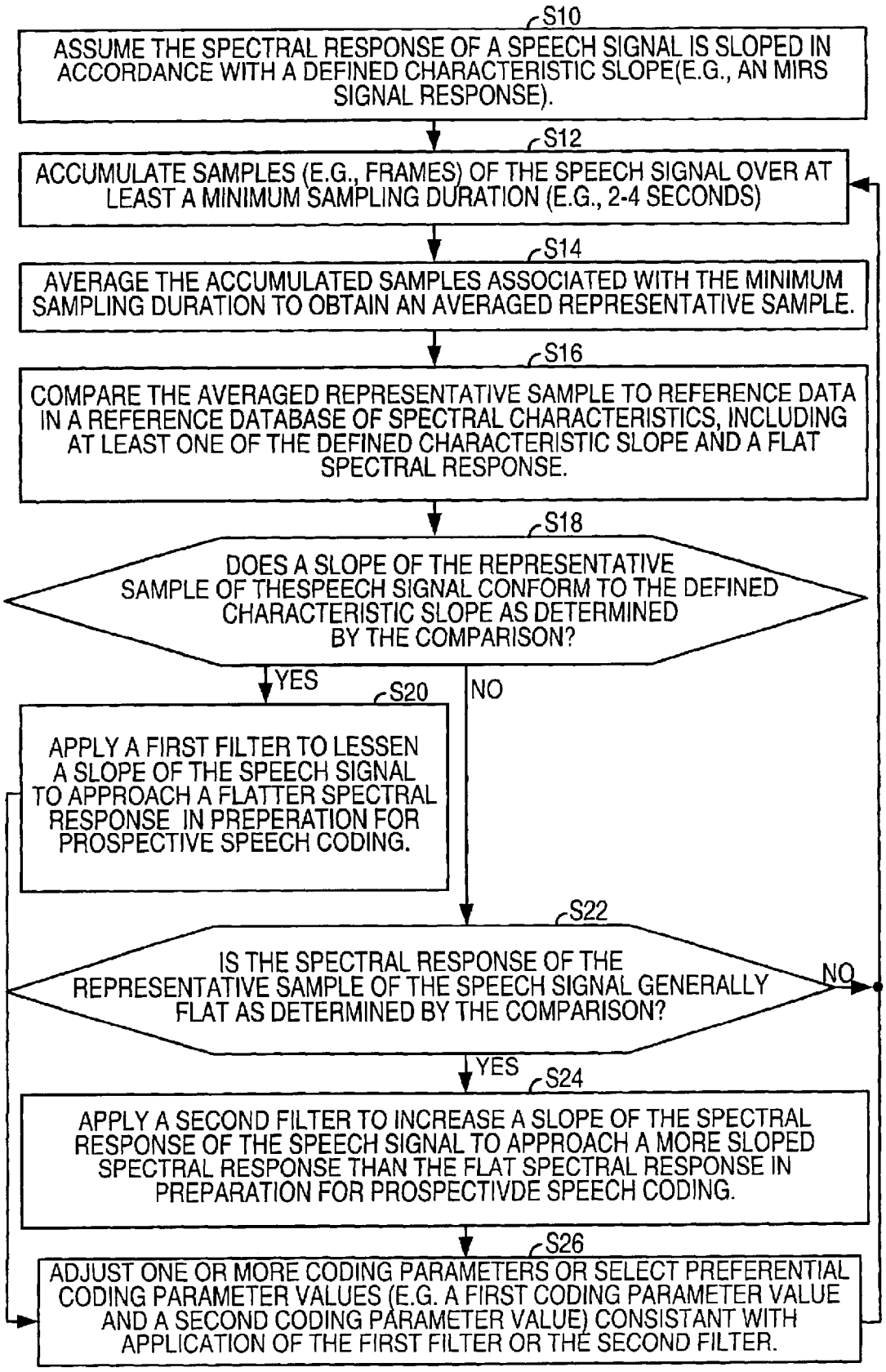
FIG. 5 is a flow chart of a method of signal processing.

FIG. 5 shows a method of signal processing in preparation for coding speech. The method of FIG. 5 begins in step S10.

In step S10, during an initial evaluation period, the signal processing system 221 or the filtering module 132 may assume that the spectral response of a speech signal is sloped in accordance with a defined characteristic slope (e.g., a first spectral response or an MIRS signal response). A wireless service operator may adopt the foregoing assumption on the spectral response or may refuse to adopt the foregoing assumption based upon the prevalence of the MIRS signal response in telecommunications infrastructure (e.g., communications network 117) associated with the wireless server operator's wireless network, for example. A spectral response of the voice signal results from the interaction of the voice signal and its original spectral content with a communications signal path, a communications network, or a network element (e.g., a fixed subscriber station 118).

In one embodiment, the signal processing system 221 may temporarily assume that the spectral response of a speech signal is sloped in accordance with the defined characteristic slope prior to completion of accumulating samples during a minimum sampling period and/or the determining whether the slope of the representative sample of the speech signal actually conforms to the defined characteristic slope. For example, during the initial evaluation period, the evaluator 162 sends a selection control data to the selector 164 to initially invoke the first filter 166 as an initial default filter for application to speech signal with a defined characteristic slope or an assumed, defined characteristic slope.

The initial evaluation period of step S10 refers to a time period prior to the passage of at least a minimum sampling duration or prior to the accumulation of a minimum number of samples for an accurate determination of the spectral response of the input speech signal. Once the initial evaluation period expires and actual measurements of the spectral response of the speech signal are available, the signal processing system 221 may no longer assume, without actual verification, that the spectral response of the speech signal is sloped in accordance with the defined characteristic slope.

In an alternate embodiment, the spectral detector 154 preferably determines or verifies whether a voice signal is closest to the defined characteristic slope or another reference spectral response prior to invoking the first filter 166 or the second filter 168, even as a temporary measure during the initial evaluation period. Accordingly, the voice signal may be sent through a filter bypass signal path, rather than the first filter 166 or the second filter 168.

In step S12, the buffer memory 156 accumulates samples (e.g., frames) of the speech signal over at least the minimum sampling duration (e.g., 2–4 seconds). For example, a sample may represent an average of the speech signal's amplitude versus frequency response during a frame that is approximately 20 milliseconds long. Accordingly, a minimum sampling period may be expressed as a minimum number of samples (e.g., 100 to 200 samples) which are equivalent to the aforementioned sampling duration.

In step S14, an averaging unit 158 or the spectral detector 154 evaluates the samples or frames associated with the minimum sampling period to provide a statistical expression or representative sample of the frames. For example, the averaging unit 158 averages the accumulated samples associated with the minimum sampling duration to obtain a representative sample or averaged speech parameters.

In step S16, an evaluator 162 accesses a reference parameter database 160 or a storage device to obtain reference data on a reference amplitude versus frequency response of a reference speech signal during a minimum sampling duration. Further, the evaluator 162 compares the representative sample or the statistical expression to the reference data in the reference parameter database 160. The reference data generally represents an amplitude versus frequency response. The reference data may include one or more of the following items: (1) a defined characteristic slope (e.g., a first spectral response), (2) a flat spectral response (e.g., second spectral response), and (3) a target spectral response.

FIG. 2A and FIG. 2B show illustrative examples of the defined characteristic slope and the flat spectral response, respectively. In practice, the defined characteristic slope or the flat spectral response may be defined in accordance with geometric equations or by entries within one or more look-up tables of the reference parameter database 160.

In step S18, the data processor determines if the slope of the representative sample of the speech signal conforms to the defined characteristic slope within a maximum permissible tolerance in accordance with the comparison of step S16. If the slope of the representative sample conforms to the defined characteristic slope within the maximum permissible tolerance, then the method continues with step S20. If the slope of the representative sample does not conform to the defined characteristic slope, then the method continues with step S22.

In step S20, which may occur after step S18, the selector 164 may apply a first filter 166 to lessen a slope of the speech signal to approach a flatter spectral response in preparation for prospective speech coding (e.g., encoding or decoding). The flatter spectral response may be referred to as an intermediate spectral response.

In step S22, the data processor determines if the spectral response of the representative sample of the speech signal is generally flat within a maximum permissible tolerance in accordance with the comparison of step S16. If the spectral response of the representative sample is generally flat within a maximum permissible tolerance, then the method continues with step S24. If the spectral response of the representative speech signal is sloped or not sufficiently flat, the method returns to step S12.

In step S24, which may occur after step S22, the selector 164 applies a second filter 168 to increase a slope of the spectral response of the speech signal to approach a more sloped spectral response than the flat spectral response in preparation for prospective speech coding (e.g., encoding or decoding). The more sloped spectral response may be referred to as an intermediate spectral response, which lies between the defined characteristic slope and the flat spectral response. The intermediate slope achieved in step S24 may be, but need not be, equivalent to the intermediate slope achieved in step S20. The method promotes uniformity in the spectral response of the speech signal that is inputted into the coder (e.g., encoder 11). The filtering module 132 adjusts the spectral response to achieve an intermediate slope or energy normalization in preparation for subsequent coding of speech. The energy normalization supports a coding process that yields a perceptually superior reproduction of speech.

In step S26, the coder (e.g., encoder 11) may adjust one or more coding parameters or select preferential coding parameter values (e.g., a first coding parameter value or a second coding parameter value) consistent with the application of the first filter 166 in step S20 or the second filter 168 in step S24. One or more coding parameters are adjusted or selected based on a degree of slope or flatness in an input speech signal to improve the perceptual content of the encoded speech. For example, the preferential coding parameter values may be selected from a set of candidate coding parameter values based on the degree of slope or flatness in the speech signal.

The adjusting or selection of step S26 may be carried out in accordance with several alternative techniques, which to some extent depend upon whether the speech is being encoded or decoded. In the context of encoding, the adjusting or selection of step S26 may include selection of preferential values for one or more of the following encoding parameters: (1) pitch gains per frame or subframe, (2) at least one weighting filter coefficient of a perceptual weighting filter in the encoder, (3) at least one bandwidth expansion constant associated with filter coefficients of a synthesis filter (e.g., short-term predictive filter) of the encoder 11, and (4) at least one bandwidth expansion constant associated with filter coefficients of an analysis filter of the encoder 11 to support a desired level of quality of perception of the reproduced speech. For encoding, the evaluator 162 or the selector 164 may provide the necessary information (e.g., flatness or slope indicator) for selection of encoding parameters that are correlated to or consistent with the selection of the first filter 166 or the second filter 168.

In the context of decoding, the adjusting or selection of step S26 may include selection of preferential values for one or more of the following decoding parameters: (1) at least one bandwidth expansion constant associated with a synthesis filter of a decoder and (2) at least one linear predictive filter coefficient associated with a post filter. For decoding, the evaluator 162 or the selector 164 may provide the necessary information (e.g., flatness or slope indicator or another spectral-content indicator) for selection of one or more preferential values of decoding parameters that are correlated to or consistent with the selection of the first filter 166 or the second filter 168. For example, the evaluator 162 associated with the encoder 11 may provide a spectral-content indicator for transmission over an air interface to the decoder 120 so that the decoder 120 may apply decoding parameters rapidly to the encoded speech without first decoding the speech to evaluate the spectral content of the speech. Similarly, the evaluator 162 may provide a spectral-content indicator for transmission over the air interface to the decoder 120 so that the post-filter 71 may apply filtering parameters rapidly consistent with the spectral response of the encoded speech signal without first decoding the coded speech signal to determine the spectral content of the coded speech signal.

In an alternative embodiment, the decoder 120 is associated with a detector for detecting the spectral content of the speech signal after decoding the encoded speech signal. Further, the detector provides a spectral-content indicator as feedback to the decoder 120, the post filter 71, or both for adjusting of decoding or filtering parameters, respectively.

In the context of encoding, decoding, or both, the adjustment or setting of at least one coding parameter may include adjusting or setting at least one preferential coding parameter value in response to the selection of the first filter 166 or the second filter 168. For example, a decoding parameter may be adjusted or set to a revised decoding parameter (e.g., a first coding parameter value or a second coding parameter value) consistent with a corresponding selection of a first filter 166 or a second filter 168. Similarly, an encoding parameter may be adjusted or set to a revised encoding parameter consistent with a corresponding selection of a first filter 166 or a second filter 168. The invocation or selection of the first filter 166 may be associated with the selection of a first value of a coding parameter (i.e. first coding parameter value), whereas the selection of the second filter 168 may be associated with the selection of a second value of a coding parameter (i.e., second coding parameter value).

The evaluator 162 is coupled to a coder (e.g., encoder 11). The evaluator 162 is capable of sending a flatness indicator or a slope indicator to the coder (e.g., encoder 11) that indicates whether or not the speech signal is sloped or the degree of such slope. The flatness indicator or slope indicator may be used to determine (1) an adjusted value for the pitch gains, (2) the perceptual weighting filter coefficients and (3) the linear predictive coding bandwidth expansion of a coding filter, or another applicable coding parameter. The flatness indicator or slope indicator may provide a finer indication of the spectral content that that based on the selection of the first filter 166 or the second filter 168 would otherwise provide. Accordingly, the slope indicator may be used to select preferential values of coding parameters or to fine tune the preferential values of coding parameters initially determined in accordance with another technique. In one example, the bandwidth expansion of a speech signal may be adjusted to change a value of a linear predictive filter for a synthesis filter or an analysis filter from a previous value based on a degree of slope or flatness in the speech signal.

The coder (e.g., encoder 11) determines pitch gain of a frame during a preprocessing stage prior to encoding the frame. The coder (e.g., encoder 11) estimates the pitch gain to minimize a mean-squared error between a target speech signal and a derived speech signal (e.g., warped, modified speech signal). The pitch gains are preferably quantized.

The first gain adjuster 38 or the second gain adjuster 52 may refer to a codebook of quantized entries of pitch gain. The pitch gain may be updated as frequently as on a frame-by-frame basis. The pitch gain may be modified consistent with one or more pitch parameters to enhance a perceptual representation of the derived speech signal that is closer to the target signal.

The coder (e.g., encoder 11) may apply perceptual weighting the speech signal outputted by the first filter 166 or the second filter 168. The coder (e.g., encoder 11) may include weighting filters. Perceptual weighting manipulates an envelope of the speech signal to mask noise that would otherwise be heard by a listener. The perceptual weighting includes a filter with a response that compresses the amplitude of the speech signal to reduce fading regions of the speech signal with unacceptable low signal-to-noise. The coefficients of the perceptual weighting filter may be adjusted to reduce a listener's perception of noise based on a detected slope or flatness of the speech signal, as indicated by the flatness indicator or the slope indicator.

A coding system may incorporate an assortment of coding filters that operate according to the selection of one or more coding parameter values (e.g., a first coding parameter value or a second coding parameter value). An analysis filter represents a reciprocal of the transform of a corresponding synthesis filter for a encoder-decoder pair. A post filter represents a filter coupled to a decoder for performing an inverse signal processing operation with respect to the encoder.

Figure 6:
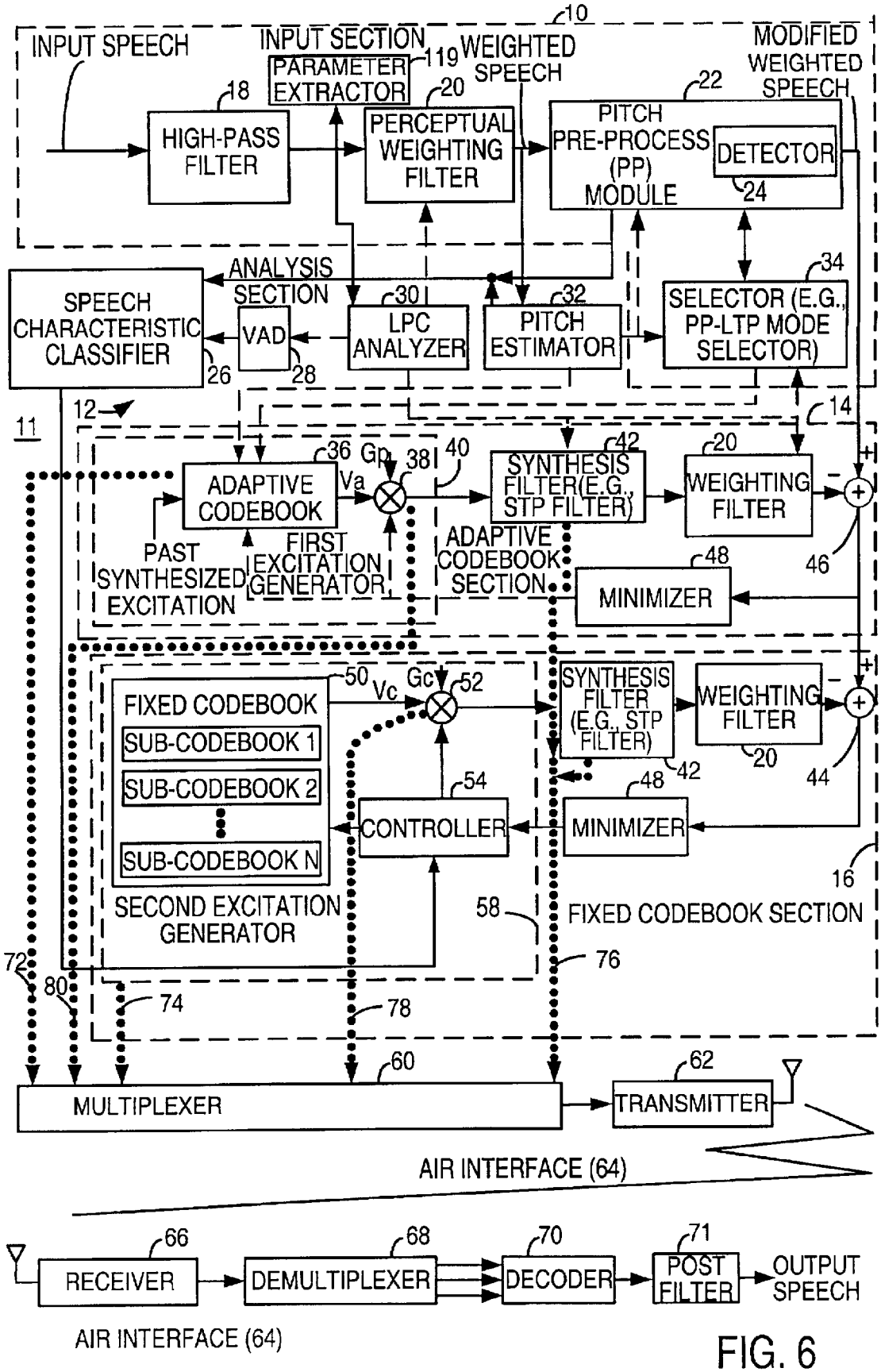
FIG. 6 is a block diagram that shows an encoder of FIG. 1 and FIG. 3 in greater detail.

FIG. 6 shows an illustrative embodiment of the encoder 11. Like reference numbers indicate like elements in FIG. 1 and FIG. 6, although FIG. 6 primarily illustrates the uplink signal path of FIG. 1. FIG. 6 illustrates the details of one illustrative configuration of the encoder 11. Further, FIG. 6 includes a multiplexer 60 and a demultiplexer 68, which were omitted from FIG. 1 solely for the sake of simplicity. The encoder 11 includes an input section 10 coupled to an analysis section 12 and an adaptive codebook section 14. In turn, the adaptive codebook section 14 is coupled to a fixed codebook section 16. A multiplexer 60, associated with both the adaptive codebook section 14 and the fixed codebook section 16, is coupled to a transmitter 62.

The transmitter 62 and a receiver 128 along with a communications protocol represent an air interface 64 of a wireless system. The input speech from a source or speaker is applied to the encoder 11 at the encoding site. The transmitter 62 transmits an electromagnetic signal (e.g., radio frequency or microwave signal) from an encoding site to a receiver 128 at a decoding site, which is remotely situated from the encoding site. The electromagnetic signal is modulated with reference information representative of the input speech signal. A demultiplexer 68 demultiplexes the reference information for input to the decoder 120. The decoder 120 produces a replica or representation of the input speech, referred to as output speech, at the decoder 120.

The input section 10 has an input terminal for receiving an input speech signal. The input terminal feeds a high-pass filter 18 that attenuates the input speech signal below a cut-off frequency (e.g., 80 Hz) to reduce noise in the input speech signal. The high-pass filter 18 feeds a perceptual weighting filter 20 and a linear predictive coding (LPC) analyzer 30. The perceptual weighting filter 20 may feed both a pitch pre-processing module 22 and a pitch estimator 32. Further, the perceptual weighting filter 20 may be coupled to an input of a first summer 46 via the pitch pre-processing module 22. The pitch pre-processing module 22 includes a detector 24 for detecting a triggering speech characteristic.

In one embodiment, the detector 24 may refer to a classification unit that (1) identifies noise-like unvoiced speech and (2) distinguishes between non-stationary voiced and stationary voiced speech in an interval of an input speech signal. The detector 24 may detect or facilitate detection of the presence or absence of a triggering characteristic (e.g., a generally voiced and generally stationary speech component) in an interval of input speech signal. In another embodiment, the detector 24 may be integrated into both the pitch pre-processing module 22 and the speech characteristic classifier 26 to detect a triggering characteristic in an interval of the input speech signal. In yet another embodiment, the detector 24 is integrated into the speech characteristic classifier 26, rather than the pitch pre-processing module 22. Where the detector 24 is so integrated, the speech characteristic classifier 26 is coupled to a selector 34.

The analysis section 12 includes the LPC analyzer 30, the pitch estimator 32, a voice activity detector 28, and a speech characteristic classifier 26. The LPC analyzer 30 is coupled to the voice activity detector 28 for detecting the presence of speech or silence in the input speech signal. The pitch estimator 32 is coupled to a mode selector 34 for selecting a pitch pre-processing procedure or a responsive long-term prediction procedure based on input received from the detector 24.

The adaptive codebook section 14 includes a first excitation generator 40 coupled to a synthesis filter 42 (e.g., short-term predictive filter). In turn, the synthesis filter 42 feeds a perceptual weighting filter 20. The weighting filter 20 is coupled to an input of the first summer 46, whereas a minimizer 48 is coupled to an output of the first summer 46. The minimizer 48 provides a feedback command to the first excitation generator 40 to minimize an error signal at the output of the first summer 46. The adaptive codebook section 14 is coupled to the fixed codebook section 16 where the output of the first summer 46 feeds the input of a second summer 44 with the error signal.

The fixed codebook section 16 includes a second excitation generator 58 coupled to a synthesis filter 42 (e.g., short-tern predictive filter). In turn, the synthesis filter 42 feeds a perceptual weighting filter 20. The weighting filter 20 is coupled to an input of the second summer 44, whereas a minimizer 48 is coupled to an output of the second summer 44. A residual signal is present on the output of the second summer 44. The minimizer 48 provides a feedback command to the second excitation generator 58 to minimize the residual signal.

In one alternate embodiment, the synthesis filter 42 and the perceptual weighting filter 20 of the adaptive codebook section 14 are combined into a single filter.

In another alternate embodiment, the synthesis filter 42 and the perceptual weighting filter 20 of the fixed codebook section 16 are combined into a single filter. In yet another alternate embodiment, the three perceptual weighting filters 20 of the encoder may be replaced by two perceptual weighting filters 20, where each perceptual weighting filter 20 is coupled in tandem with the input of one of the minimizers 48. Accordingly, in the foregoing alternate embodiment the perceptual weighting filter 20 from the input section 10 is deleted.

In accordance with FIG. 6, an input speech signal is inputted into the input section 10. The input section 10 decomposes speech into component parts including (1) a short-term component or envelope of the input speech signal, (2) a long-term component or pitch lag of the input speech signal, and (3) a residual component that results from the removal of the short-term component and the long-term component from the input speech signal. The encoder 11 uses the long-term component, the short-term component, and the residual component to facilitate searching for the preferential excitation vectors of the adaptive codebook 36 and the fixed codebook 50 to represent the input speech signal as reference information for transmission over the air interface 64.

The perceptual weighing filter 20 of the input section 10 has a first time versus amplitude response that opposes a second time versus amplitude response of the formants of the input speech signal. The formants represent key amplitude versus frequency responses of the speech signal that characterize the speech signal consistent with an linear predictive coding analysis of the LPC analyzer 30. The perceptual weighting filter 20 is adjusted to compensate for the perceptually induced deficiencies in error minimization, which would otherwise result, between the reference speech signal (e.g., input speech signal) and a synthesized speech signal.

The input speech signal is provided to a linear predictive coding (LPC) analyzer 30 (e.g., LPC analysis filter) to determine LPC coefficients for the synthesis filters 42 (e.g., short-term predictive filters). The input speech signal is inputted into a pitch estimator 32. The pitch estimator 32 determines a pitch lag value and a pitch gain coefficient for voiced segments of the input speech. Voiced segments of the input speech signal refer to generally periodic waveforms.

The pitch estimator 32 may perform an open-loop pitch analysis at least once a frame to estimate the pitch lag. Pitch lag refers a temporal measure of the repetition component (e.g., a generally periodic waveform) that is apparent in voiced speech or voice component of a speech signal. For example, pitch lag may represent the time duration between adjacent amplitude peaks of a generally periodic speech signal. As shown in FIG. 6, the pitch lag may be estimated based on the weighted speech signal. Alternatively, pitch lag may be expressed as a pitch frequency in the frequency domain, where the pitch frequency represents a first harmonic of the speech signal.

The pitch estimator 32 maximizes the correlations between signals occurring in different sub-frames to determine candidates for the estimated pitch lag. The pitch estimator 32 preferably divides the candidates within a group of distinct ranges of the pitch lag. After normalizing the delays among the candidates, the pitch estimator 32 may select a representative pitch lag from the candidates based on one or more of the following factors: (1) whether a previous frame was voiced or unvoiced with respect to a subsequent frame affiliated with the candidate pitch delay; (2) whether a previous pitch lag in a previous frame is within a defined range of a candidate pitch lag of a subsequent frame, and (3) whether the previous two frames are voiced and the two previous pitch lags are within a defined range of the subsequent candidate pitch lag of the subsequent frame. The pitch estimator 32 provides the estimated representative pitch lag to the adaptive codebook 36 to facilitate a starting point for searching for the preferential excitation vector in the adaptive codebook 36. The adaptive codebook section 11 later refines the estimated representative pitch lag to select an optimum or preferential excitation vector from the adaptive codebook 36.

The speech characteristic classifier 26 preferably executes a speech classification procedure in which speech is classified into various classifications during an interval for application on a frame-by-frame basis or a subframe-by-subframe basis. The speech classifications may include one or more of the following categories: (1) silence/background noise, (2) noise-like unvoiced speech, (3) unvoiced speech, (4) transient onset of speech, (5) plosive speech, (6) non-stationary voiced, and (7) stationary voiced. Stationary voiced speech represents a periodic component of speech in which the pitch (frequency) or pitch lag does not vary by more than a maximum tolerance during the interval of consideration. Non-stationary voiced speech refers to a periodic component of speech where the pitch (frequency) or pitch lag varies more than the maximum tolerance during the interval of consideration. Noise-like unvoiced speech refers to the nonperiodic component of speech that may be modeled as a noise signal, such as Gaussian noise. The transient onset of speech refers to speech that occurs immediately after silence of the speaker or after low amplitude excursions of the speech signal. A speech classifier may accept a raw input speech signal, pitch lag, pitch correlation data, and voice activity detector data to classify the raw speech signal as one of the foregoing classifications for an associated interval, such as a frame or a subframe. The foregoing speech classifications may define one or more triggering characteristics that may be present in an interval of an input speech signal. The presence or absence of a certain triggering characteristic in the interval may facilitate the selection of an appropriate encoding scheme for a frame or subframe associated with the interval.

A first excitation generator 40 includes an adaptive codebook 36 and a first gain adjuster 38 (e.g., a first gain codebook). A second excitation generator 58 includes a fixed codebook 50, a second gain adjuster 52 (e.g., second gain codebook), and a controller 54 coupled to both the fixed codebook 50 and the second gain adjuster 52. The fixed codebook 50 and the adaptive codebook 36 define excitation vectors. Once the LPC analyzer 30 determines the filter parameters of the synthesis filters 42, the encoder 11 searches the adaptive codebook 36 and the fixed codebook 50 to select proper excitation vectors. The first gain adjuster 38 may be used to scale the amplitude of the excitation vectors of the adaptive codebook 36. The second gain adjuster 52 may be used to scale the amplitude of the excitation vectors in the fixed codebook 50. The controller 54 uses speech characteristics from the speech characteristic classifier 26 to assist in the proper selection of preferential excitation vectors from the fixed codebook 50, or a subcodebook therein.

The adaptive codebook 36 may include excitation vectors that represent segments of waveforms or other energy representations. The excitation vectors of the adaptive codebook 36 may be geared toward reproducing or mimicking the long-term variations of the speech signal. A previously synthesized excitation vector of the adaptive codebook 36 may be inputted into the adaptive codebook 36 to determine the parameters of the present excitation vectors in the adaptive codebook 36. For example, the encoder may alter the present excitation vectors in its codebook in response to the input of past excitation vectors outputted by the adaptive codebook 36, the fixed codebook 50, or both. The adaptive codebook 36 is preferably updated on a frame-by-frame or a subframe-by-subframe basis based on a past synthesized excitation, although other update intervals may produce acceptable results and fall within the scope of the invention.

The excitation vectors in the adaptive codebook 36 are associated with corresponding adaptive codebook indices. In one embodiment, the adaptive codebook indices may be equivalent to pitch lag values. The pitch estimator 32 initially determines a representative pitch lag in the neighborhood of the preferential pitch lag value or preferential adaptive index. A preferential pitch lag value minimizes an error signal at the output of the first summer 46, consistent with a codebook search procedure. The granularity of the adaptive codebook index or pitch lag is generally limited to a fixed number of bits for transmission over the air interface 64 to conserve spectral bandwidth. Spectral bandwidth may represent the maximum bandwidth of electromagnetic spectrum permitted to be used for one or more channels (e.g., downlink channel, an uplink channel, or both) of a communications system. For example, the pitch lag information may need to be transmitted in 7 bits for half-rate coding or 8-bits for full-rate coding of voice information on a single channel to comply with bandwidth restrictions. Thus, 128 states are possible with 7 bits and 256 states are possible with 8 bits to convey the pitch lag value used to select a corresponding excitation vector from the adaptive codebook 36.

The encoder 11 may apply different excitation vectors from the adaptive codebook 36 on a frame-by-frame basis or a subframe-by-subframe basis. Similarly, the filter coefficients of one or more synthesis filters 42 may be altered or updated on a frame-by-frame basis. However, the filter coefficients preferably remain static during the search for or selection of each preferential excitation vector of the adaptive codebook 36 and the fixed codebook 50. In practice, a frame may represent a time interval of approximately 20 milliseconds and a sub-frame may represent a time interval within a range from approximately 5 to 10 milliseconds, although other durations for the frame and sub-frame fall within the scope of the invention.

The adaptive codebook 36 is associated with a first gain adjuster 38 for scaling the gain of excitation vectors in the adaptive codebook 36. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The first excitation generator 40 is coupled to a synthesis filter 42. The first excitation vector generator 40 may provide a long-term predictive component for a synthesized speech signal by accessing appropriate excitation vectors of the adaptive codebook 36. The synthesis filter 42 outputs a first synthesized speech signal based upon the input of a first excitation signal from the first excitation generator 40. In one embodiment, the first synthesized speech signal has a long-term predictive component contributed by the adaptive codebook 36 and a short-term predictive component contributed by the synthesis filter 42.

The first synthesized signal is compared to a weighted input speech signal. The weighted input speech signal refers to an input speech signal that has at least been filtered or processed by the perceptual weighting filter 20. As shown in FIG. 6, the first synthesized signal and the weighted input speech signal are inputted into a first summer 46 to obtain an error signal. A minimizer 48 accepts the error signal and minimizes the error signal by adjusting (i.e., searching for and applying) the preferential selection of an excitation vector in the adaptive codebook 36, by adjusting a preferential selection of the first gain adjuster 38 (e.g., first gain codebook), or by adjusting both of the foregoing selections. A preferential selection of the excitation vector and the gain scalar (or gain vector) apply to a subframe or an entire frame of transmission to the decoder 120 over the air interface 64. The filter coefficients of the synthesis filter 42 remain fixed during the adjustment or search for each distinct preferential excitation vector and gain vector.

The second excitation generator 58 may generate an excitation signal based on selected excitation vectors from the fixed codebook 50. The fixed codebook 50 may include excitation vectors that are modeled based on energy pulses, pulse position energy pulses, Gaussian noise signals, or any other suitable waveforms. The excitation vectors of the fixed codebook 50 may be geared toward reproducing the short-term variations or spectral envelope variation of the input speech signal. Further, the excitation vectors of the fixed codebook 50 may contribute toward the representation of noise-like signals, transients, residual components, or other signals that are not adequately expressed as long-term signal components.

The excitation vectors in the fixed codebook 50 are associated with corresponding fixed codebook indices 74. The fixed codebook indices 74 refer to addresses in a database, in a table, or references to another data structure where the excitation vectors are stored. For example, the fixed codebook indices 74 may represent memory locations or register locations where the excitation vectors are stored in electronic memory of the encoder 11.

The fixed codebook 50 is associated with a second gain adjuster 52 for scaling the gain of excitation vectors in the fixed codebook 50. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The second excitation generator 58 is coupled to a synthesis filter 42 (e.g., short-term predictive filter), which may be referred to as a linear predictive coding (LPC) filter. The synthesis filter 42 outputs a second synthesized speech signal based upon the input of an excitation signal from the second excitation generator 58. As shown, the second synthesized speech signal is compared to a difference error signal outputted from the first summer 46. The second synthesized signal and the difference error signal are inputted into the second summer 44 to obtain a residual signal at the output of the second summer 44. A minimizer 48 accepts the residual signal and minimizes the residual signal by adjusting (i.e., searching for and applying) the preferential selection of an excitation vector in the fixed codebook 50, by adjusting a preferential selection of the second gain adjuster 52 (e.g., second gain codebook), or by adjusting both of the foregoing selections. A preferential selection of the excitation vector and the gain scalar (or gain vector) apply to a subframe or an entire frame. The filter coefficients of the synthesis filter 42 remain fixed during the adjustment.

The LPC analyzer 30 provides filter coefficients for the synthesis filter 42 (e.g., short-term predictive filter). For example, the LPC analyzer 30 may provide filter coefficients based on the input of a reference excitation signal (e.g., no excitation signal) to the LPC analyzer 30. Although the difference error signal is applied to an input of the second summer 44, in an alternate embodiment, the weighted input speech signal may be applied directly to the input of the second summer 44 to achieve substantially the same result as described above.

The preferential selection of a vector from the fixed codebook 50 preferably minimizes the quantization error among other possible selections in the fixed codebook 50. Similarly, the preferential selection of an excitation vector from the adaptive codebook 36 preferably minimizes the quantization error among the other possible selections in the adaptive codebook 36. Once the preferential selections are made in accordance with FIG. 6, a multiplexer 60 multiplexes the fixed codebook index 74, the adaptive codebook index 72, the first gain indicator (e.g., first codebook index), the second gain indicator (e.g., second codebook gain), and the filter coefficients associated with the selections to form reference information. The filter coefficients may include filter coefficients for one or more of the following filters: at least one of the synthesis filters 42, the perceptual weighing filter 20 and other applicable filter.

A transmitter 62 or a transceiver is coupled to the multiplexer 60. The transmitter 62 transmits the reference information from the encoder 11 to a receiver 128 via an electromagnetic signal (e.g., radio frequency or microwave signal) of a wireless system as illustrated in FIG. 6. The multiplexed reference information may be transmitted to provide updates on the input speech signal on a subframe-by-subframe basis, a frame-by-frame basis, or at other appropriate time intervals consistent with bandwidth constraints and perceptual speech quality goals.

The receiver 128 is coupled to a demultiplexer 68 for demultiplexing the reference information. In turn, the demultiplexer 68 is coupled to a decoder 120 for decoding the reference information into an output speech signal. As shown in FIG. 6, the decoder 120 receives reference information transmitted over the air interface 64 from the encoder 11. The decoder 120 uses the received reference information to create a preferential excitation signal. The reference information facilitates accessing of a duplicate adaptive codebook and a duplicate fixed codebook to those at the encoder 70. One or more excitation generators of the decoder 120 apply the preferential excitation signal to a duplicate synthesis filter. The same values or approximately the same values are used for the filter coefficients at both the encoder 11 and the decoder 120. The output speech signal obtained from the contributions of the duplicate synthesis filter and the duplicate adaptive codebook is a replica or representation of the input speech inputted into the encoder 1. Thus, the reference data is transmitted over an air interface 64 in a bandwidth efficient manner because the reference data is composed of less bits, words, or bytes than the original speech signal inputted into the input section 10.

In an alternate embodiment, certain filter coefficients are not transmitted from the encoder to the decoder, where the filter coefficients are established in advance of the transmission of the speech information over the air interface 64 or are updated in accordance with internal symmetrical states and algorithms of the encoder and the decoder.

The synthesis filter 42 (e.g., a short-term synthesis filter) may have a response that generally conforms to the following equation:

$$\frac{1}{A(z)} = \frac{1}{1 - \sum_{i=1}^{P} a_{i\,revised} z^{-i}},$$

where 1/A(z) is the filter response represented by a z transfer function, $a_{i\ revised}$ is a linear predictive coefficient, i=1 . . . P, and P is the prediction or filter order of the synthesis filter. Although the foregoing filter response may be used, other filter responses for the synthesis filter 42 may be used. For example, the above filter response may be modified to include weighting or other compensation for input speech signals.

If the response of the synthesis filter 42 of the encoder 11 is expressed as 1/A(z), a response of a corresponding analysis filter of the decoder 120 or the LPC analyzer 30 is expressed as A(z) in accordance with the following equation:

$$A(z) = 1 - \sum_{i=1}^{P} a_{i\,modified} z^{-i}$$

where $a_{i\ modified}$ is the non-quantized equivalent of $a_{i\ revised}$. Thus, the same or similar bandwidth expansion constants or filter coefficients may be applied to a synthesis filter 42, a corresponding analysis filter, or both. During coding, the analysis filter coefficients (i.e., $a_{i\ modified}$) are applied to a bandwidth expansion and then quantized. Synthesis filter coefficients (i.e., $a_{i\ revised}$) are derivable from the expanded, quantized analysis filter coefficients.

The coder (e.g., encoder 11) may code speech differently in accordance with differences in the detected spectral characteristics of the input speech. For example, in the selecting or adjusting step S26 of FIG. 5, a first value of the bandwidth expansion constant for a defined characteristic slope may be assigned to differ from a second value of the bandwidth expansion constant for a generally flat spectral response. The first value of the bandwidth expansion constant is an example of a first coding parameter value, consistent with step S26 of FIG. 5. The second value of the bandwidth expansion constant is an example of a second coding parameter value. If the spectral response is regarded as generally sloped in accordance with a defined characteristic slope (e.g., first spectral response), the linear predictive bandwidth expander may use a first value of bandwidth expansion constant (e.g., $\gamma$=0.99). On the other hand, if the spectral response is regarded as generally flat (e.g., second spectral response), the linear predictive bandwidth expander may use a second value of bandwidth expansion constant (e.g., $\gamma$=0.995) distinct from the first value of the bandwidth expansion constant.

The LPC analyzer 30 may include an LPC bandwidth expander. In one embodiment, the LPC analyzer 30 receives a flatness or slope indicator of the speech signal from the evaluator 162 in the filtering module 132. The LPC bandwidth expander or the LPC analyzer 30 may follow the following equation:

$a_{i\ revised} = a_{i\ previous}\gamma^{i}$, where $a_{i\ revised}$ is a revised linear predictive coefficient, $a_{i\ previous}$ is a previous linear predictive coefficient, $\gamma$ is the bandwidth expansion constant, i=1 . . . P, and P is the prediction order of a synthesis filter or analysis filter of the encoder 11. In the foregoing equation, $a_{i\ previous}$ represents a member of the set of extracted linear predictive coefficients $\{a_{i\ previous}\}^{P}_{i=1}$, for the synthesis filter 42 of the encoder 11 or an analysis filter. In one embodiment, $\gamma$ is set to a first value (e.g., 0.99) if the generally sloped response is consistent with MIRS speech or a first spectral response. Similarly, in one embodiment, $\gamma$ is set to a second value (e.g., 0.995) for input speech with a generally flat input signal or a second spectral response.

The revised linear predictive coefficient $a_{i\ revised}$ incorporates the bandwidth expansion constant $\gamma$ into the filter response 1/A(z) of the synthesis filter 42 to provide a desired degree of bandwidth expansion based on the degree of flatness or slope of the input speech signal. The bandwidth expander applies the revised linear predictive coefficients to one or more synthesis filters 42 on a frame-by frame or subframe-by-subframe basis.

The encoder 11 may encode speech differently in accordance with differences in the detected spectral characteristics of the input speech. If the spectral response is regarded as generally sloped in accordance with a defined characteristic slope (e.g., first spectral response), the perceptual weighting filter 20 may use a first value for the weighting constant (e.g., $\alpha$=0.2). On the other hand, if the spectral response is regarded as generally flat (e.g., second spectral response), the perceptual weighting filter 20 may use a second value for the weighting constant (e.g., $\alpha$=0) distinct from the first bandwidth constant. The first value of the weighting constant is an example of a first coding parameter value and the second value of the weighting constant is an example of a second coding parameter value, consistent with step S26 of FIG. 5.

The frequency response of the perceptual weighting filter 20 may be expressed generally as the following equation:

$$W(z) = \frac{1}{1-\alpha z^{-1}} \frac{1+\sum_{i=1}^{P} a_i \rho^i z^{-i}}{1+\sum_{i=1}^{P} a_i \beta^i z^{-i}}$$

where $\alpha$ is a weighting constant, $\rho$ and $\beta$ are preset coefficients (e.g., values from 0 to 1), P is the predictive order or the filter order of the perceptual weighting filter 20, and $\{a_i\}$ is the linear predictive coding coefficient. The perceptual weighting filter 20 controls the value of a based on the spectral response of the input speech signal.

For example, in the adjusting or selection of preferential coding parameter values of step S26 of FIG. 5, different values of the weighting constant a may be selected to adjust the frequency response of the perceptual weighting filter in response to the determined slope or flatness of the speech signal. In one embodiment, $\alpha$ approximately equals 0.2 for generally sloped input speech consistent with the MIRS spectral response or a first spectral response. Similarly, in one embodiment $\alpha$ approximately equals 0 for an input speech signal with a generally flat signal response or a second spectral response.

The decoder 120 may be associated with the application of different post-filtering to encoded speech in accordance with differences in the detected spectral characteristics of the input speech. As shown in FIG. 6, the post filter 71 may be coupled to the output of the decoder 120 or otherwise incorporated into the coding system of the invention. If the spectral response of the input speech signal is regarded as generally sloped in accordance with a defined characteristic slope (e.g., the first spectral response), the post filter may use a first set of values for the post-filtering constants (e.g., $\gamma_1$=0.65 and $\gamma_2$=0.4). On the other hand, if the spectral response is regarded as generally flat (e.g., the second spectral response), the post filter may use a second set of values for the post-filtering weighting constants (e.g., $\gamma_1$=0.63 and $\gamma_2$=0.4) distinct from the first set of values of the post-filtering weighting constants. The first set of values of post-filtering weighting constants and the second set of values of post-filtering weighting constants are examples of coding parameter values, consistent with step S26 of FIG. 5.

The frequency response of the post filter 71 may be expressed as the following equation:

$$P(z) = \frac{1+\sum_{i=1}^{P} a_i \gamma_1^i z^{-i}}{1+\sum_{i=1}^{P} a_i \gamma_2^i z^{-i}}$$

where $\gamma_1$ and $\gamma_2$ represents a set of post-filtering weighting constants and $\{a_i\}$ is the linear predictive coding coefficient.

Referring to step S26 of FIG. 5, a frequency response of a post filter 71 coupled to an output of a decoder may be adjusted based on a degree of slope or flatness of the speech signal. The post filter 71 controls the value of $\gamma_1$ and $\gamma_2$ based on the spectral response of the input speech. For instance, the adjustment of a frequency response of a post filter may involve selecting different values of post-filtering weighting constants of $\gamma_1$ and $\gamma_2$ in response to the determined slope or flatness of the speech signal. In one embodiment, $\gamma^1$ and $\gamma^2$ approximately equal 0.65 and 0.4, respectively, for generally sloped input speech consistent with the MIRS spectral response. Similarly, in one embodiment $\gamma_1$ and $\gamma^2$ approximately equals 0.63 and 0.4, respectively, for an input speech signal with a generally flat signal response.

Figure 7:
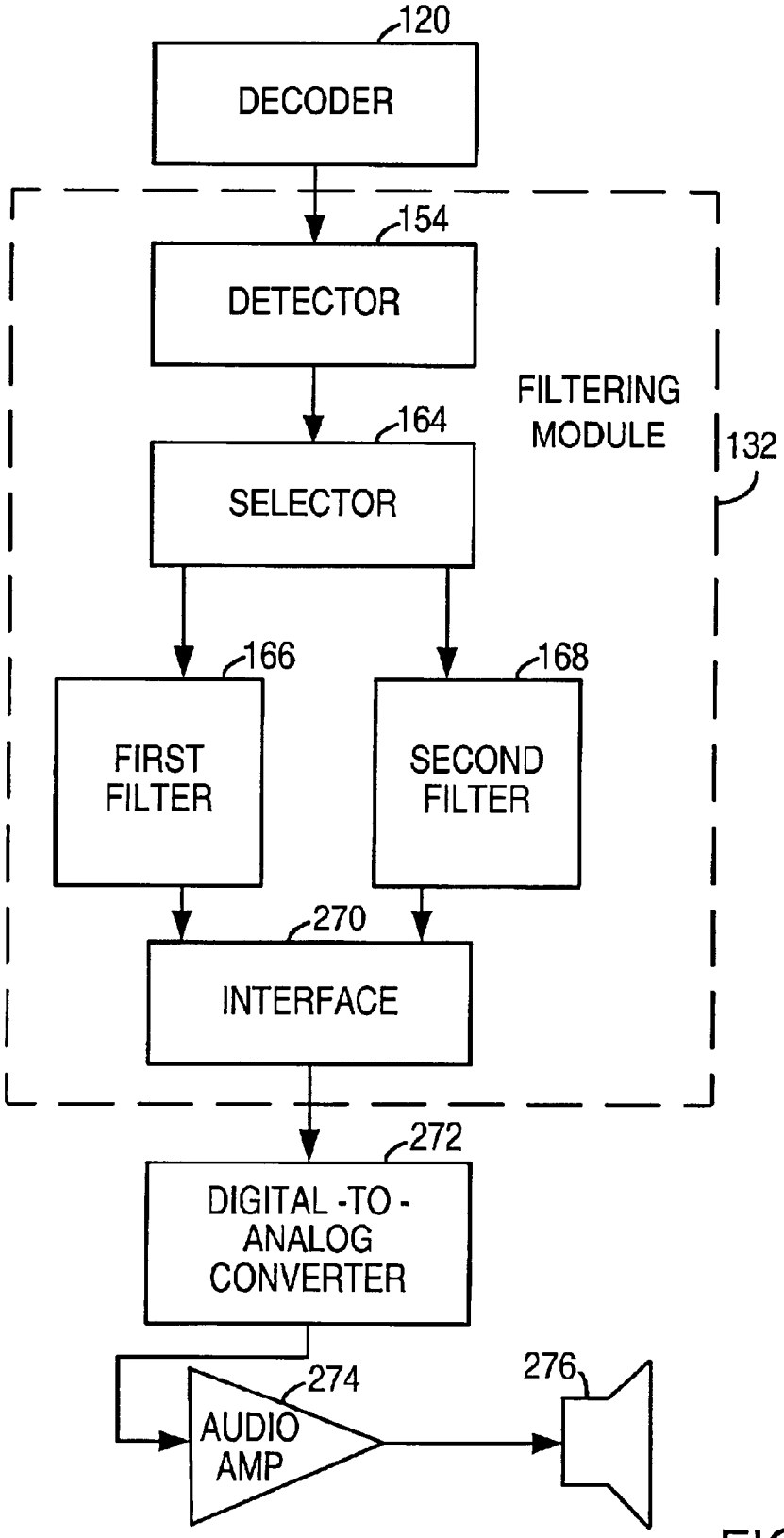
FIG. 7 is a block diagram of an alternate signal processing system that supports decoding an encoded speech signal.

FIG. 7 illustrates an alternate embodiment of a signal processing system in which a filtering module 132 is associated with the decoder 120. The signal processing system of FIG. 7 may be used as an alternative to the signal processing system 221 of FIG. 1 or in addition to the signal processing system 221 of FIG. 1 to achieve tandem manipulation of the speech signal to a more uniform or intermediately sloped spectral response.

In FIG. 7, the decoder 120 decodes the encoded signal by performing the inverse filtering operation of the encoder 11. For example, the decoder 120 applies an excitation signal and a filter coefficient, on a frame-by-frame basis or according to some other time interval, as determined by the encoder 11. The spectral detector 154 determines whether the decoded speech signal has a first frequency response, a second frequency response, or another defined frequency response. In one embodiment, the first frequency response and the second frequency response may be the equivalent of the first spectral response and the second spectral response, respectively. However, in an alternate embodiment, the first frequency response may differ from the first spectral response and the second frequency response may differ from the second spectral response.

The selector 164 directs the speech signal to the first filter 166 if the speech signal conforms to the first frequency response. Otherwise, the selector 164 directs the speech signal to the second filter 168 if the speech signal conforms to the second frequency response. The first filter 166 or the second filter 168 provides an intermediate frequency response that is generally intermediate in slope characteristics with respect to the first frequency response and the second frequency response. Accordingly, the intermediate frequency response represents a response that is generally flat or slightly sloped to produce reliable, intelligible audio representing the speech signal.

The speech signal consistent with the intermediate frequency response is inputted to an interface 270 that prepares the speech signal for input into a digital-to-analog converter 272. An audio amplifier 274 is coupled to the digital-to-analog converter 272. In turn, the audio amplifier 274 is coupled to a speaker 276 for reproducing the speech signal with a desired spectral response.

Figure 8:
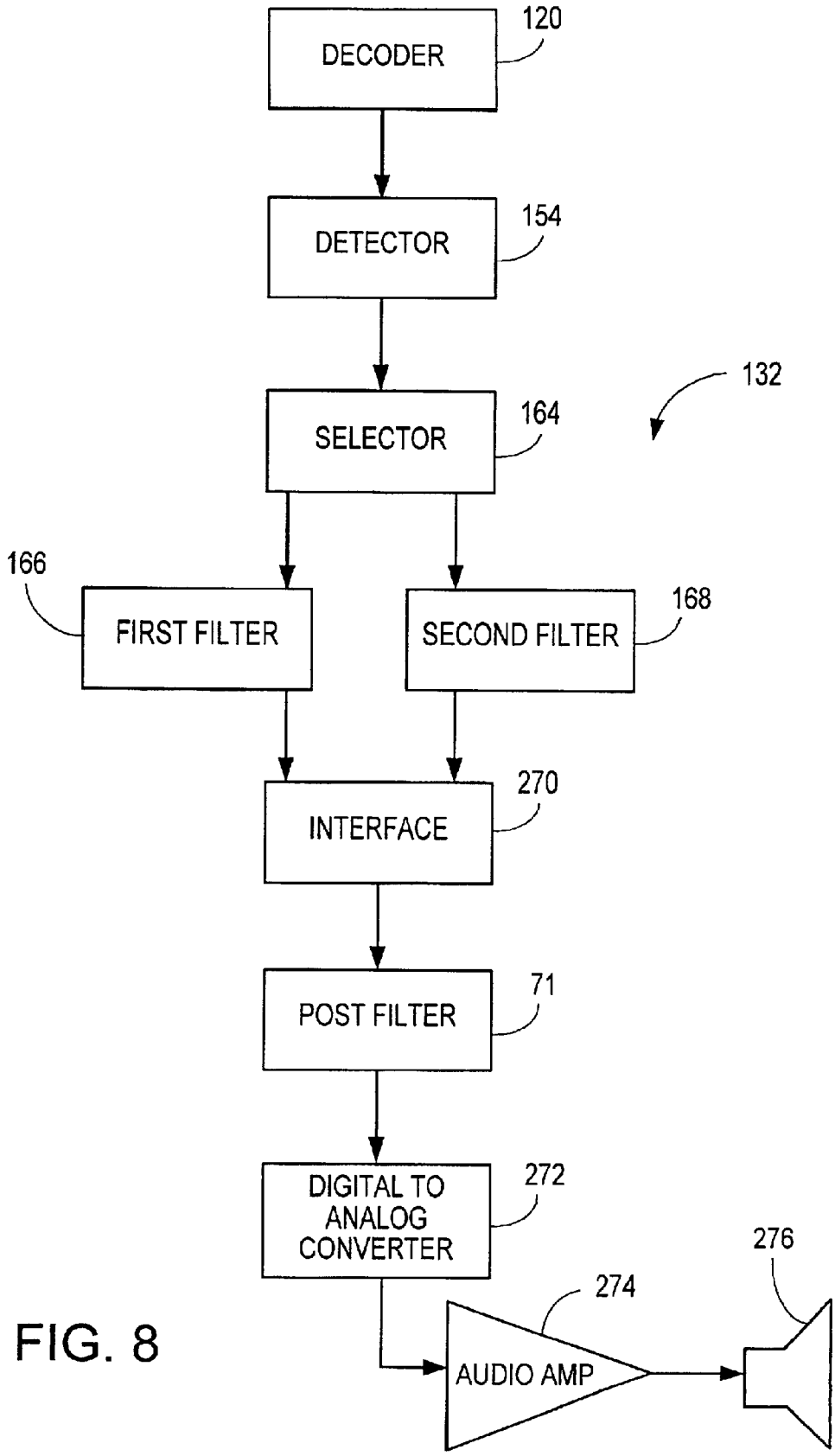
FIG. 8 is a block diagram of another alternate embodiment of a signal processing system that supports decoding an encoded speech sample.

FIG. 8 is a block diagram of another alternate embodiment of a signal processing system associated with the decoder 120 in accordance with the invention. The configuration of FIG. 8 is similar to the configuration of FIG. 7 except that FIG. 8 includes the post filter 71. Like reference numbers indicate like elements in FIG. 1, FIG. 7 and FIG. 8.

Although the post-filter 71 is placed in the signal path between the interface 270 and the digital-to-analog converter 272, the post-filter may be placed in the signal path at other places between decoder 120 and the digital-to-analog converter 272. For example, in an alternate configuration, the post-filter 71 may be placed in a signal path between the detector 154 and the selector 164.

A multi-rate encoder may include different encoding schemes to attain different transmission rates over an air interface. Each different transmission rate may be achieved by using one or more encoding schemes. The highest coding rate may be referred to as fill-rate coding. A lower coding rate may be referred to as one-half-rate coding where the one-half-rate coding has a maximum transmission rate that is approximately one-half the maximum rate of the full-rate coding. An encoding scheme may include an analysis-by-synthesis encoding scheme in which an original speech signal is compared to a synthesized speech signal to optimize the perceptual similarities or objective similarities between the original speech signal and the synthesized speech signal. A code-excited linear predictive coding scheme (CELP) is one example of an analysis-by synthesis encoding scheme. Although the signal processing system of the invention is primarily described in conjunction with an encoder 11 that is well-suited for full-rate coding and half-rate coding, the signal processing system of the invention may be applied to lesser coding rates than half-rate coding or other coding schemes.

The signal processing method and system of the invention facilitates a coding system that dynamically adapts to the spectral characteristics of the speech signal on as short as a frame-by-frame basis. Accordingly, the filtering characteristics of the encoder 11 or decoder 120 may be selected based on a speech signal with a uniform spectral response. Further, the encoder 11 or decoder 120 may apply perceptual adjustments to the speech to promote intelligibility of reproduced speech from the speech signal with the uniform spectral response.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A method for conditioning a speech signal in preparation for coding of the speech signal, the method comprising the steps of:

accumulating samples of the speech signal over at least a minimum sampling duration;

evaluating the accumulated samples associated with the minimum sampling period to obtain a representative sample;

determining whether a slope of the representative sample of the speech signal conforms to a defined characteristic slope stored in a reference database of spectral characteristics; and selecting one of a first filter and a second filter for application to the speech signal prior to the coding;

wherein the selecting step selects the first filter if the determining step determines that the slope of the representative sample of the speech signal conforms to the defined characteristic slope, and wherein the selecting step selects the second filter if the determining step determines that the slope of the representative sample of the speech signal is generally flat.

2. The method according to claim 1 further comprising the step of applying the first filter to lessen a slope of the speech signal to approach a flatter spectral response in preparation for the coding.

3. The method according to claim 1 further comprising the step of applying the second filter to increase a slope of the spectral response of the speech signal to approach a more sloped spectral response than the flat spectral response in preparation for the coding.

4. The method according to claim 1 where the evaluating step comprises averaging the accumulated samples over the minimum sampling duration to obtain the representative sample.

5. The method according to claim 1 further comprising the step of assuming the spectral response of a speech signal is sloped in accordance with the defined characteristic slope prior to completion of at least one of the accumulating step and the determining step.

6. The method according to claim 5 wherein the selecting step comprises selecting the first filter as an initial default filter based on the assumption that the spectral response of the speech signal is sloped in accordance with the defined characteristic slope.

7. The method according to claim 1 where the defined characteristic slope approximately represents a Modified Intermediate Reference System.

8. The method according to claim 1 further comprising the step of adjusting at least one encoding parameter to a revised encoding parameter for an encoding process, the at least one encoding parameter affiliated with the selecting of one of the first filter and the second filter.

9. The method according to claim 8 where the adjusting step comprises adjusting an encoding parameter selected from the group consisting of pitch gains per frame or subframe, at least one filter coefficient of a perceptual weighting filter, at least one bandwidth expansion constant associated with a synthesis filter, and at least one bandwidth expansion constant associated with an analysis filter.

10. The method according to claim 1 further comprising the step of adjusting at least one decoding parameter to a revised decoding parameter for a decoding process, the at least one decoding parameter affiliated with the selecting of one of the first filter and the second filter.

11. The method according to claim 10 where the adjusting step comprises adjusting a decoding parameter selected from the group consisting of at least one bandwidth expansion constant associated with a synthesis filter and at least one linear predictive filter coefficient associated with a post filter.

12. The method according to claim 1 further comprising the step of adjusting at least one coding parameter to a revised coding parameter for at least one of an encoding and a decoding process, the at least one coding parameter affiliated with the selecting of one of the first filter and the second filter.

13. The method according to claim 12 where the adjusting step comprises adjusting a coding parameter selected from the group consisting of pitch gains per frame or subframe, at least one filter coefficient of a perceptual weighting filter, at least one bandwidth expansion constant associated with a synthesis filter, at least one bandwidth expansion constant associated with an analysis filter, and at least one linear predictive filter coefficient associated with a post filter.

14. The method according to claim 1 further comprising adjusting a bandwidth expansion of the speech signal to change a value of a linear predictive coefficient for at least one of a synthesis filter and an analysis filter from a previous value to a revised value based on a degree of slope or flatness in the speech signal.

15. The method according to claim 1 further comprising adjusting bandwidth expansion of the speech signal in conformance with the following equations:

$$\frac{1}{A(z)} = \frac{1}{1 - \sum_{i=1}^{P} a_{i\,revised} z^{-i}},$$

where 1/A(z) is a filter response represented by a z transfer function, $a_{i\ previous}$ is a linear predictive coefficient, i=1 . . . P, and P is the prediction order or filter order of the synthesis filter, $a_{i\ revised} = a_{i\ previous}\gamma^{i}$, where $a_{i\ revised}$ is a revised linear predictive coefficient, $a_{i\ previous}$ is a previous linear predictive coefficient, γ is the bandwidth expansion constant, i=1 . . . P, and P is the prediction order of the synthesis filter of the encoder, and where $a_{i\ previous}$ represents a member of the set of extracted linear predictive coefficients $\{a_{i\ previous}\}^{P}_{i=1}$, for the synthesis filter of the encoder.

16. The method according to claim 15 where the value of the bandwidth expansion constant for a generally flat spectral response differs from that of the defined characteristic slope.

17. The method according to claim 15 where the value of the bandwidth expansion constant is greater for a generally flat spectral response than the defined characteristic slope.

18. The method according to claim 15 where γ is set to a first value of approximately 0.99 if the slope of the representative sample is consistent with an MIRS spectral response and γ is set to a second value of approximately 0.995 where the slope of the representative sample is generally flat or approaches zero.

19. The method according to claim 1 further comprising adjusting a frequency response of a perceptual weighting filter based on a degree of slope or flatness in the speech signal.

20. The method according to claim 1 further comprising adjusting a frequency response of a perceptual weighting filter based on the following equation:

$$W(z) = \frac{1}{1 - \alpha z^{-1}} \frac{1 + \sum_{i=1}^{P} a_i \rho^i z^{-i}}{1 + \sum_{i=1}^{P} a_i \beta^i z^{-i}}$$

where α is a weighting constant as the value of the coding parameter, β and ρ are preset coefficients, P is the predictive order, and $\{a_i\}$ is the linear predictive coding coefficient.

21. The method according to claim 20 wherein the adjusting step comprises selecting different values of the weighting constant a to adjust the frequency response of the perceptual weighting filter in response to the determined slope or flatness of the speech signal.

22. The method according to claim 20 further comprising controlling the value of a based on the spectral response of the speech signal such that a approximately equals 0.2 where the speech signal is consistent with the MIRS spectral response and a approximately equals 0 where the speech signal is consistent with a generally flat signal response.

23. The method according to claim 1 further comprising the step of adjusting a frequency response of a post filter coupled to an output of a decoder based on a degree of slope or flatness of the speech signal.

24. The method according to claim 1 further comprising the step of adjusting a frequency response of a post filter in accordance with the following equation:

$$P(z) = \frac{1 + \sum_{i=1}^{P} a_i \gamma_1^i z^{-i}}{1 + \sum_{i=1}^{P} a_i \gamma_2^i z^{-i}}$$

where $\gamma_1$ and $\gamma_2$ represents a set of post-filtering weighting constants in which the value is a member of the set, {ai} is the linear predictive coding coefficient, and P is the filter order of the post filter.

25. The method according to claim 24 further comprising the step of adjusting a frequency response of a post filter by selecting different values of post-filtering weighting constants of $\gamma_1$ and $\gamma_2$ in response to the determined slope or flatness of the speech signal.

26. The method according to claim 24 where $\gamma_1$ and $\gamma_2$ approximately equal 0.65 and 0.4, respectively, if the speech signal is consistent with an MIRS spectral response; and where $\gamma_1$ and $\gamma_2$ approximately equal 0.63 and 0.4, respectively, if the speech signal is consistent with a generally flat signal response.

27. A system for conditioning a speech signal prior to coding the speech signal, the system comprising:

a buffer memory for accumulating samples of the speech signal over at least a minimum sampling duration;

an averaging unit for evaluating the accumulated samples associated with the minimum sampling period to obtain a representative sample;

a storage device adapted to store spectral characteristics for classifying the speech signal as a closest one of a defined characteristic slope and a flat speech signal;

an evaluator adapted to determine whether a slope of the representative sample of the speech signal conforms to a defined characteristic slope stored in the storage device; and a selector for selecting a preferential one of a first filter and a second filter for application to the speech signal prior to the coding;

wherein the selector selects the first filter if the evaluator determines that the slope of the representative sample of the speech signal conforms to the defined characteristic slope, and wherein the selector selects the second filter if the evaluator determines that the slope of the representative sample of the speech signal is generally flat.

28. The system according to claim 27 where the first filter has a filtering response that lessens a slope of the speech signal to approach a flatter spectral response in preparation for subsequent coding.

29. The system according to claim 27 where the second filter increases a slope of the spectral response of the speech signal to approach a more sloped spectral response than the flat spectral response in preparation for prospective speech coding.

30. The system according to claim 27 where the evaluator comprises an averaging unit is adapted to average the accumulated samples over the minimum sampling duration to obtain the representative sample.

31. The system according to claim 27 where the evaluator assumes the spectral response of a speech signal is sloped in accordance with the defined characteristic slope prior to the expiration of the minimum sampling duration.

32. The system according to claim 27 where the defined characteristic slope approximately represents a Modified Intermediate Reference System.

33. The system according to claim 27 where the evaluator triggers an adjustment of at least one encoding parameter to a revised encoding parameter during the encoding process, the at least one encoding parameter affiliated with one of the first filter and the second filter.

34. The system according to claim 27 where the evaluator is coupled to an encoder, where the evaluator sends a flatness or slope indicator to the encoder for controlling coding parameters of a group consisting of pitch gains per frame or subframe, at least one filter coefficient of a perceptual weighting filter of the encoder, at least one filter coefficient of a synthesis filter of the encoder, at least one bandwidth expansion constant associated with a synthesis filter of at least one of the encoder and a decoder, at least one bandwidth expansion constant associated with a synthesis filter of a decoder, at least one bandwidth expansion constant associated with an analysis filter of an encoder, and at least one filtering coefficient associated with a post filter coupled to a decoder for performing an inverse signal processing operations with respect to the encoder.

* * * * *